US005116711A

United States Patent [19]

Kobayashi et al.

[11] Patent Number: 5,116,711

[45] Date of Patent: May 26, 1992

[54] COLOR TONER AND TWO-COMPONENT DEVELOPER CONTAINING SAME

[75] Inventors: Hiroyuki Kobayashi, Yokohama; Mitsuru Uchida, Chofu; Kenji Okado, Yokohama, all of Japan

[73] Assignee: Canon Kabushiki Kaisha, Tokyo, Japan

[21] Appl. No.: 504,696

[22] Filed: Apr. 5, 1990

Related U.S. Application Data

[63] Continuation of Ser. No. 117,753, Nov. 6, 1987, abandoned.

[30] Foreign Application Priority Data

Jan. 19, 1987 [JP] Japan ..... 62-009467

[51] Int. Cl.[5] ..... G03G 9/083; G03G 9/09; G03G 9/107

[52] U.S. Cl. ..... 430/106; 430/106.6; 430/110; 430/108

[58] Field of Search ..... 430/106.6, 106, 45, 430/110

[56] References Cited

U.S. PATENT DOCUMENTS

| | | | |
|---|---|---|---|
| 2,618,552 | 11/1952 | Wise | 430/109 |
| 2,811,465 | 10/1957 | Greig . | |
| 2,874,063 | 3/1953 | Greig . | |
| 3,825,427 | 7/1974 | Inoue . | |
| 3,840,464 | 10/1974 | Van Engeland | 430/108 |
| 3,909,266 | 9/1975 | Inoue . | |
| 3,910,231 | 10/1975 | Inoue . | |
| 3,938,992 | 2/1976 | Jadwin | 430/120 |
| 3,998,747 | 12/1976 | Yamakami . | |
| 4,066,563 | 1/1978 | Mammino et al. . | |
| 4,135,925 | 1/1979 | Wells . | |
| 4,297,427 | 10/1981 | Williams et al. . | |
| 4,448,870 | 5/1984 | Imai . | |
| 4,518,672 | 5/1985 | Urawa . | |
| 4,590,139 | 5/1986 | Imai et al. . | |
| 4,614,700 | 9/1986 | Yamamoto et al. . | |
| 4,615,612 | 10/1986 | Ohno et al. . | |
| 4,622,281 | 11/1986 | Imai . | |

FOREIGN PATENT DOCUMENTS

| | | |
|---|---|---|
| 0143535A1 | 6/1985 | European Pat. Off. . |
| 3540297 | 5/1986 | Fed. Rep. of Germany . |
| 2157521 | 6/1973 | France . |
| 1402009 | 8/1975 | United Kingdom . |
| 2014876 | 9/1979 | United Kingdom . |
| 2082788 | 3/1982 | United Kingdom . |

*Primary Examiner*—Roland Martin

*Attorney, Agent, or Firm*—Fitzpatrick, Cella, Harper & Scinto

[57] ABSTRACT

Four color toners of yellow, magenta, cyan and black, and four two-component developers containing the four color toners respectively in combination with a resin-coated ferrite carrier suitable for multi-color electrophotographic copying are provided. Each of the four-color toners is strictly regulated in relation not only to the carrier but also to the other color toners. More specifically, each color toner is strictly controlled with respect to a particle size distribution, freeness from agglomeration, melting characteristics including heat-absorption peaks and apparent viscosity on melting, chromaticity, triboelectric chargeability and optical toner concentration detection characteristic. Because of the strict regulation of these various parameters, the resultant multi-color toner or developer system shows excellent performances at every stage of multi-color electrophotography including development, transfer and fixing (color-mixing) for a long period of successive copying.

15 Claims, 6 Drawing Sheets

COLOR TONER AND TWO-COMPONENT DEVELOPER CONTAINING SAME

This application is a continuation of application Ser. No. 117,753 filed Nov. 6, 1987, which is now abandoned.

FIELD OF THE INVENTION AND RELATED ART

The present invention relates to toners for multi-color or full-color electrophotography for providing multi-color images. In particular, the present invention relates to yellow, magenta, cyan and black toners for providing a wide range of clear multi-colors and two-component developers containing the same.

In recent years, in image forming apparatus such as a copying machine, conversion is proceeding from mono-color copying to full-color copying extensively and two-color copying machines and full-color copying machines are being commercially developed. There have also been published reports on color-reproduction characteristic and gradation-reproduction characteristic, for example, by "Denshi Shashin Gakkai-shi (Journal of Electrophotographic Society, Japan)" Vol. 22, No. 1(1983), and ibid. Vol. 25, No. 1, P. 52 (1986).

For people accustomed to seeing television pictures, photographic pictures and color prints which have been processed to provide color pictures even perhaps more beautiful than actual objects, full-color electrophotographic picture images commercially available heretofore have not necessarily reached a satisfactory level.

Color image formation by full-color electrophotography is generally effected by reproducing colors by using color toner generally of yellow, magenta and cyan primary colors.

More specifically, the process is carried out by causing light rays from an original to be incident on a photoconductive layer through a color-separation transmission filter (in a complementary color with a toner color) to form an electrostatic latent image on the photoconductive layer. Then, the toner of the color is held on a support (material) such as plain paper through developing and transfer steps. The above steps are repeated for toners of other colors several times to register with and superpose on the previous toner image on the support, and the superposed toner images are subjected to a single fixing step to provide a final full-color image.

The developing may be effected by known developing process, such as the cascade process disclosed in U.S. Pat. No. 2,618,552; the magnetic brush process disclosed in U.S. Pat. No. 2,874,063; and the touch-down process disclosed in U.S. Pat. No. 2,811,465.

Among these processes, the magnetic brush process has been most widely used. In such process, magnetic particles such as particles of steel or ferrite are used as a carrier. A two-component developer comprising a toner and a magnetic carrier is held on the surface of a developer-carrying member such as a cylindrical sleeve containing a magnetic field-generating means such as a magnet. The developer is thus disposed in the form of a brush under the action of the resultant magnetic field. When the magnetic brush contacts the surface of the photo-conductive layer having an electrostatic latent image, the toner in the brush is attracted to the electrostatic latent image to develop the latent image. In this process, however, the toner is only contained and available in a small portion of the magnetic brush formed at the developing station, so that the developing efficiency is low. For example, there can be a case where only 1-5% of the toner in the brush is available. When a large amount of developer is used in order to increase the developing efficiency, it requires a large and thus heavy developing apparatus, which is not suitable for providing a small and light copying machine. Particularly, a full-color copying machine requires at least three developing apparatus or units, so that it is difficult to provide a compact full-color copying machine.

In respect of image quality, the magnetic brush process involves problems in that developed images are accompanied with irregularities due to traces of rubbing with the magnetic brush, and the triboelectric charging characteristic of the carrier deteriorates due to strong mixing between the toner and the carrier so that the toner is also attached to a non-image portion to provide fog.

In full-color electrophotography wherein development is effected in several times to provide a superposition of several toner layers of different colors on the same support, a color toner is required to satisfy the following conditions:

(1) A fixed toner is required to have been substantially completely melted to such an extent that the particle shapes of the fixed toner cannot be recognized, so as not to hinder color-reproduction due to random reflection.

(2) A fixed color toner layer is required to have sufficient transparency so as not to shade a toner layer of a different color beneath it.

(3) The respective toners constituting the full-color system are required to be balanced in hues and spectral reflection characteristics and have a sufficient degree of saturation or chroma.

A color toner is required to satisfy the following electrophotographic characteristics:

(4) To have good triboelectric charging characteristic independent of environmental conditions.

(5) To have a good conveying characteristic so that it is smoothly supplied from a hopper to a developer and to have a good mixing characteristic so that it is readily mixed with the carrier and the remaining developer.

(6) To have a good storage stability so as to be free from caking or agglomeration in use or in storage.

However, no color toner proposed heretofore satisfies the above requirements to a satisfactory level.

For example, we have already proposed a combination of three specific toners of three primary colors (Japanese Laid-Open Patent Application No. 26757/1984).

The above combination provides a good balance in respect of color reproduction but still leaves room for improvement in electrophotographic characteristics, such as charging characteristic and performances in repetitive copying other than storage stability.

Further, the black color which is obtained by superposition of the above three color toners, has a tone which is affected by a delicate change in tone of these colors or in the conditions of developing-transfer-superposition in fixing, so that it is required to accurately control the developing-transfer step and fixing step in the copying process. These factors lead to complication of the steps and increase cost.

Japanese Laid-Open Patent Application No. 68234/1978 and U.S. Pat. No. 4,518,672 disclose a color toner of a single color. In full-color development, however, it is required to provide a good color balance among at least three and preferably four colors, so that it is not significant to consider the color-reproducibility and the electrophotographic characteristic of just a single color.

In principle, it is possible to reproduce almost all colors through subtractive process from three primary colors of yellow, magenta and cyan. For this reason, full-color copying machines used at present generally have adopted a system of superposing three primary color toners. By using this system it is in principle possible to realize any color in any density range. In actuality, however, the above system leaves room for improvement in respect of spectral reflection characteristic of toners, color mixing characteristic at the time of superposition of toners and reduction in saturation because of subtractive mixing.

As described above, the provision of a black color through superposition of three colors provides a further difficulty. In selection of colorants which determine the colors of the toners, when more emphasis is put on hue, the spectral reflection the color reproduction characteristics of a toner among the above-mentioned six requirements, the electrophotographic characteristics are not sufficiently provided so that there arise problems in respect of charging characteristic, durability in repetitive copying, toner-conveying characteristic, and storability of toner. On the other hand, when more weights are put on the electrophotographic characteristics of toners, it is required to select colorants with poor color characteristics. In this way, it is extremely difficult to satisfy both the color reproduction and the electrophotographic characteristics.

SUMMARY OF THE INVENTION

As a result of earnest study for solving the above problems, we have developed useful toners of three primary colors and a black toner to arrive at a multicolor (or full-color) toner system showing a wide range of color reproducibility and excellent characteristics in developing and fixing, steps, and an image-forming process using such toner system.

Accordingly, a specific object of the present invention is to provide a full-color toner having a good spectral reflection characteristic and a two-component developer containing the same.

Another object of the present invention is to provide a full color toner system showing a good color-mixing and fixing characteristic among four color toners of yellow, magenta, cyan and black, and to provide a full-color toner having a sufficient triboelectric characteristic, and a two-component developer containing the same.

Another object of the present invention is to provide a full-color toner having a good conveying characteristic and to provide a two-component developer for full-color electrophotography providing images free from sweeping or rubbing traces.

Another object of the present invention is to provide a full-color toner with little scattering and to provide a full-color toner having a high gloss with remarkably improved image quality.

Another object of the present invention is to provide a two-component developer causing little spending to the carrier (sticking of the toner components onto carrier to cause loss of charge-imparting characteristic of the carrier), thus showing a good durability.

The present invention provides four color toner compositions suitable for constituting a color toner system for multi-color or full-color electrophotography, including a yellow toner composition, a magenta toner composition, a cyan toner composition and a black toner composition.

The yellow toner composition comprises a yellow toner which in turn comprises at least a binder resin and a yellow colorant, and a fluidity improver; the yellow toner having a volume-average particle size of 11.0 to 14.0μ, containing 30% by number or less of particles having sizes below 6.35μ and containing 9% by weight or less of particles having sizes above 20.2μ; the yellow toner composition having an agglomeration degree of 25% or below and an apparent density of 0.2 to 1.5 g/cm$^3$; the yellow toner having an apparent viscosity at 100° C. of $10^4$to $5\times10^5$ poise, an apparent viscosity at 90° C. of $5\times10^4$ to $5\times10^6$ poise, a DSC heat-absorption peak at 58° to 72° C., and a gloss of 5.0% or higher; the yellow toner containing 0.1 to 12.0 wt. parts of the yellow colorant per 100 wt. parts of the binder resin; the yellow toner having chromaticity values of $a^*=-6.5$ to $-26.5$, $b^*=73.0$ to 93.0, and $L^*=77.0$ to 97.0; the yellow toner showing a triboelectric charge of $-5$ to $-20$ μC/g with respect to a ferrite carrier coated with fluorine-containing resin-styrene type resin containing 70 wt. % or more of carrier particles having sizes of 250 mesh-pass and 350 mesh-on.

The magenta toner composition comprises a magenta toner which in turn comprises at least a binder resin and a magenta colorant, and a fluidity improver; the magenta toner having a volume-average particle size of 11.0 to 14.0μ, containing 30% by number or less of particles having sizes below 6.35μ and containing 9% by weight or less of particles having sizes above 20.2μ; the magenta toner composition having an agglomeration degree of 25% or below and an apparent density of 0.2 to 1.5 g/cm$^3$; the magenta toner having an apparent viscosity at 100° C. of $10^4$ to $5\times10^5$ poise, an apparent viscosity at 90° C. of $5\times10^4$ to $5\times10^6$ poise, a DSC heat-absorption peak at 58° to 72° C., and a gloss of 5.0% or higher; the magenta toner containing 0.1 to 15.0 wt. parts of the magenta colorant per 100 wt. parts of the binder resin; the magenta toner having chromaticity values of $a^*=60.0$ to 80.0, $b^*=-12.0$ to $-32.0$, and $L^*=40.0$ to 60.0; the magenta toner showing a triboelectric charge of $-5$ to $-20$ μC/g with respect to a ferrite carrier coated with fluorine containing resin-styrene type resin containing 70 wt. % or more of carrier particles having sizes of 250 mesh-pass and 350 mesh-on.

The cyan toner composition, comprising a cyan toner which in turn comprises at least a binder resin and a cyan colorant, and a fluidity improver; the cyan toner having a volume-average particle size of 11.0 to 14.0μ, containing 30% by number or less of particles having sizes below 6.35μ and containing 9% by weight or less of particles having sizes above 20.2μ; the cyan toner composition having an agglomeration degree of 25% or below and an apparent density of 0.2 to 1.5 g/cm$^3$; the cyan toner having an apparent viscosity at 100° C. of $10^4$ to $5\times10^5$ poise, an apparent viscosity at 90° C. of $5\times10^4$ to $5\times10^6$ poise, a DSC heat-absorption peak at 58° to 72° C., and a gloss of 5.0% or higher; the cyan toner containing 0.1 to 15.0 wt. parts of the cyan colorant per 100 wt. parts of the binder resin; the cyan toner having chromaticity values of $a^*=-8$ to $-28.0$, $b^*=-30.0$ to $-5.0$, and $L^*=39.0$ to 59.0; the cyan toner showing a triboelectric charge of $-5$ to $-20$ μC/g with respect a ferrite carrier coated with fluorine-containing resin-styrene type resin containing 70 wt. % or more of carrier particles having sizes of 250 mesh-pass and 350 mesh-on.

The black toner composition, comprising a black toner which in turn contains at least a binder resin and two or more colorants, and a fluidity improver; the black toner showing a reflectance of 40% or higher in the near infrared wavelength region of 900 to 1000 nm; the black toner having a volume-average particle size of 11.0 to 14.0μ, containing 30% by number or less of particles having sizes below 6.35μ and containing 9% by weight or less of particles having sizes above 20.2μ; the black toner composition having an agglomeration degree of 25% or below and an apparent density of 0.2 to 1.5 g/cm$^3$; the black toner having an apparent viscosity at 100° C. of $10^4$ to $5\times10^5$ poise, an apparent viscosity at 90° C. of $5\times10^9$ to $5\times10^6$ poise, a DSC heat-absorption peak at 58° to 72° C., and a gloss of 5.0% or higher; the black toner having chromaticity values of $a^*=-3.5$ to 6.5, $b^*=-6.0$ to 4.0, and $L^*=26.0$ to 36.0; the black toner showing a triboelectric charge of −5 to −20 μC/g with respect to a ferrite carrier coated with fluorine-containing resin-styrene type resin containing 70 wt. % or more of carrier particles having sizes of 250 mesh-pass and 350 mesh-on.

The present invention further provides four two-component developers each comprising one of the above yellow toner composition, magenta toner composition, cyan toner composition and black toner composition in combination with a ferrite carrier coated with a fluorine-containing resin-styrene type resin.

The present invention further provides a full-color toner kit for developing electrostatic latent images, comprising the above yellow toner composition, magenta toner composition, cyan toner composition and black toner composition.

The present invention further provides a full-color image forming process using the above mentioned four two-component developers.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
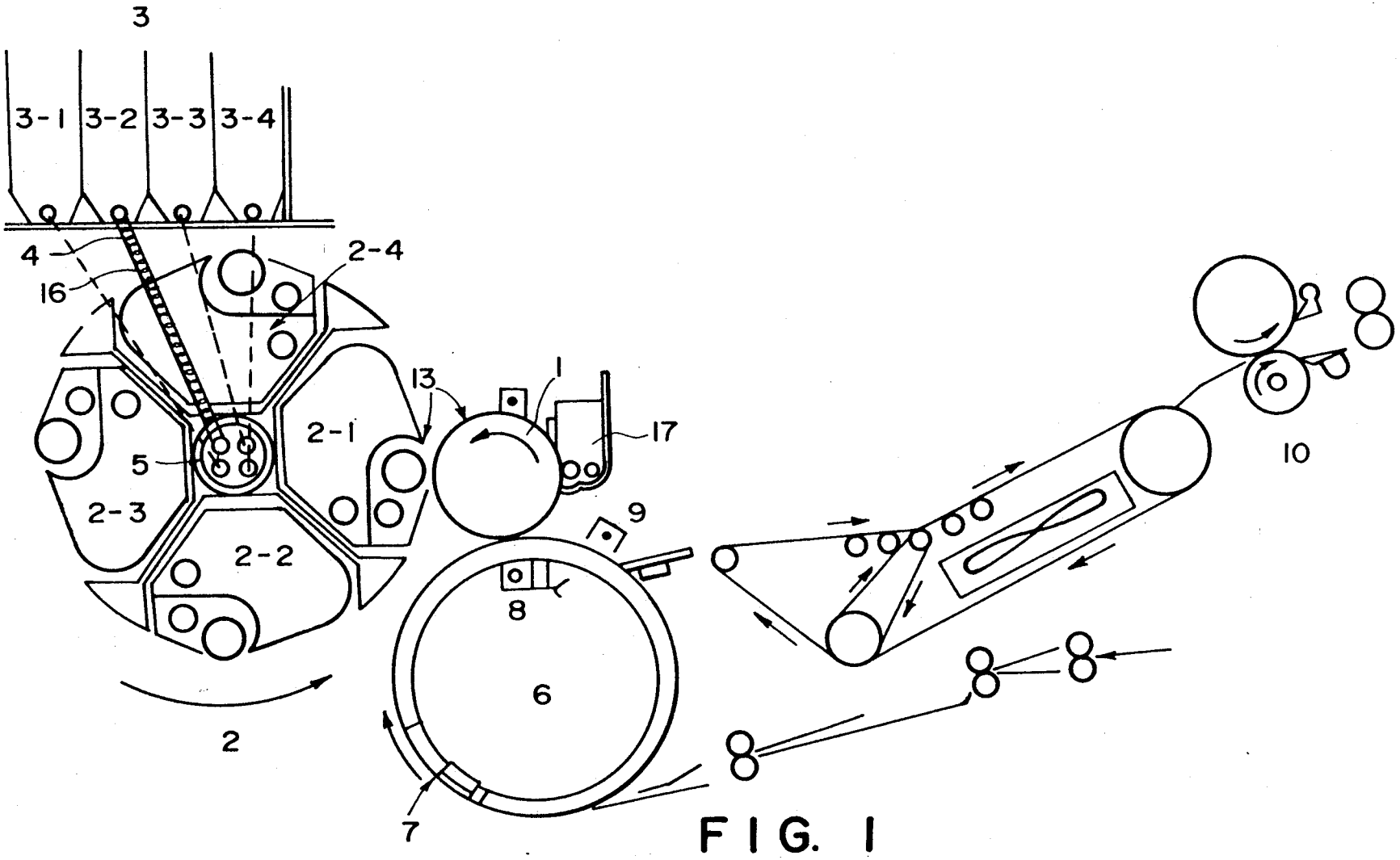
FIG. 1 is a schematic sectional view showing an outline of a color electrophotographic copying machine to which the color toner kit of the present invention is applied.

An example of a multi-color or full-color electrophotographic copying machine for practicing the color electrophotographic process according to the present invention is explained with reference to FIG. 1.

An electrostatic latent image formed on a photosensitive drum 1 by appropriate means is developed by a developer contained in a developing apparatus 2-1 fixed on a rotary developing unit 2. The resultant toner image is transferred by the operation of a transfer charger 8 onto a transfer material such as plain paper held on a transfer drum 6 by a gripper 7.

For a second color development and transfer, the rotary developing unit 2 is rotated to have a developing apparatus 2-2 face the photosensitive drum 1. A latent image on the photosensitive drum 1 is then developed by a developer in the developing apparatus 2-2, and the resultant toner image is again transferred in superposition on the same transfer material as described above.

The development and transfer are similarly conducted for third and fourth colors. In this way, the transfer drum 6 is rotated in a prescribed number of times while holding thereon the transfer material to transfer the prescribed number of color images in superposition. The corona chage for electrostatic transfer is preferably successively increased for successive color toner images by increasing the transfer current such that transfer current for first color < transfer current for second color < transfer current for third color < transfer current for fourth color. The transfer material after the multiple transfer is separated from the transfer drum 6 by means of a separation charger 9 and passed through a fixer 10 to provide a full-color copy image.

Replenishing toners supplied to developing apparatus 2-1' to 2-4 are supplied from replenishing hoppers 3 provided for respective color toners in a constant amount based on a replenishing signal through toner-conveying cables 4 to toner replenishing tubes 5 disposed at the center of the rotary developing unit 2 and then sent to the respective developing apparatus. The replenishing toner is preliminarily mixed uniformly with a developer already contained in the developing apparatus to provide a prescribed toner concentration by means of mixing-conveying screws 12 (FIG. 2) in the developing apparatus. At this time, the mixing ratio between the carrier and the toner in the developer is a very important factor from the veiwpoint of development effect.

A developer attached onto the surface of a sleeve containing therein a magnet is caused to rub an electrostatic latent image to visualize the latent image with the toner therein. As a result, the toner in the developer is gradually consumed to lower the ratio of the toner to the carrier, i.e., to lower the toner concentration. Accordingly, the toner is replenished as desired. In this instance, if the toner is replenished exceeding an appropriate level, there arise difficulties that the image density increases too much and fog is also increased. Accordingly, it is necessary to accurately detect the toner concentration in order to continuously obtain images of a preferable color tone.

Several methods for automatic control of toner concentration are known heretofore. For example, Japanese Patent Publication No. 17245/1963 has proposed a method wherein different colors of a carrier and a toner are used, a change in color of the mixture due to consumption of the toner is optically detected, and the replenishing of the toner to the developer is controlled corresponding to the change thereby to keep a constant toner concentration. This method is however not applicable where the carrier and the toner have similar colors. A widely used developer comprises a black toner comprising a mixture of a binder, carbon black and a charge control agent, and a carrier composed of powder of various iron or ferrite, such as electrolytic iron, reduced iron, atomized iron, magnetite, Fe-Zn ferrite, and Fe-Co ferrite or surface-oxidized product or surface-treated product of these powders. The diffusion reflectivities of such a carrier and a toner are both small and have a small difference therebetween. Moreover, the quantity of reflected light from the developer is small. Accordingly, it is difficult to detect the toner concentration.

Our research group has proposed a method for accurate detection of a toner concentration wherein the reflection or transmission density in an infrared region of a developer is detected (Japanese Laid-Open Patent Application No. 107853/1978). According to this method, a large change in reflectivity (change in reflecting light quantity) corresponding to a change in toner concentration is attained, so that an improved detection is attained. This method is applicable not only to white and black copying but also to color-copying. In this method, however, as the reflecting light or transmitted light from a toner in the infrared region is utilized, carbon black, iron black or nigrosine dye which has been conventionally used as a black colorant cannot be used, but it is necessary to use a colorant showing reflection or transmission in the infrared region.

As another method, Japanese Laid-Open Patent Application Nos. 63727/1973 and 11936/1982 have proposed a method wherein two or more colorants which reflect or transmit infrared rays and are not black are appropriately blended and kneaded with a binder resin to provide a black toner, and the toner is used. It is possible to obtain a black toner by combining non-black colorants. However, this proposal only aims at generating a black color through appropriate mixing of colorants as a principal object and does not consider the electrophotographic characteristics.

Thus, Japanese Patent Application No. 63727/1973 or 119363/1982 contains no specific description about factors affecting the electrophotographic characteristics other than the colorants.

We have described herein a color toner having a sufficient spectral reflection characteristic in the near infrared region and also have electrophotographic characteristics, and a two-component developer containing the toner.

Each of the yellow, magenta, cyan and black toner preferably has a spectral reflectance of 40% or more, more preferably 60% or more, particularly preferably 70% or more in the near infrared region, particularly from 900 to 1000 nm.

Theoretically, only a small difference spectral reflectance is required between the toner and the carrier. If the difference in spectral reflectance is below 40%, however, the detection becomes unstable because of factors such as the spectral transmittance of optical fiber, the spectral transmittance of a dichroic mirror, and the S/N ratio of an electric signal processing circuit in a detection apparatus, and the assembly tolerance of the detection apparatus. As a result, the carrier and the toner cannot be stably discriminated and the toner concentration cannot be quantitatively determined.

A full-color copying machine operates through the combination of a plurality of colors, so that good images cannot be obtained or retained if the difference in spectral reflectance of even one color toner is below 40%.

The degree of agglomeration of a toner intimately concerned with the conveying characteristic and the mixing characteristic of the toner is 25% or below, preferably 20% to 1.0%, more preferably 10% to 1.0%. The agglomeration degree is a measure of fluidity, and a larger value represents a poor fluidity and too low a value is liable to cause toner scattering in the apparatus because of too large a fluidity.

Figure 2:
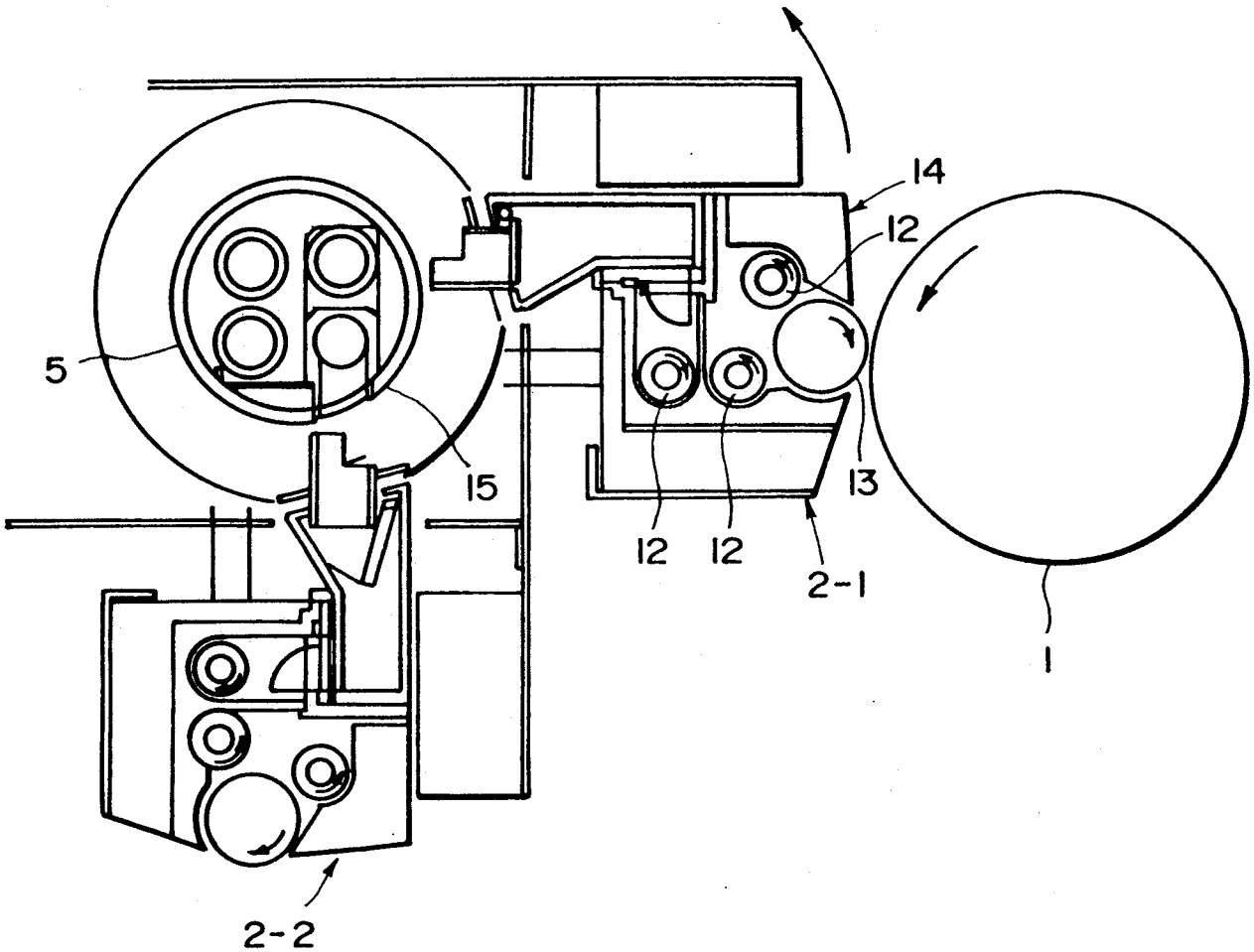
FIG. 2 is an enlarged sectional view of developer supply system and a development system of the copying machine shown in FIG. 1.

FIG. 2 is an enlarged sectional view showing an embodiment of a toner replenishing-development system using color toners according to the present invention. As a result of the operation of the system, a full-color toner kit according to the present invention is formed in situ in the apparatus. When a replenishing toner and a developer already in the developing apparatus are mixed by means of the conveying-mixing screw 12, an agglomeration degree exceeding 25% leads to poor mixing of the toner with the developer (mixing of the replenished toner with a mass of particles comprising carrier particles to the surface of which some toner particles are already attached electrostatically). As a result, a constant and uniform toner concentration cannot be realized in a short time, so that the toner concentration varies locally.

This leads to an ununiform developing characteristic of the developer on the developing sleeve 13, so that ununiform development results for the same latent image potential causing local fog or density irregularity.

On the other hand, an agglomeration degree of below 1.0% promotes the scattering of the toner in the apparatus from the developing sleeve and cause the soiling of a corona charging wire. Further, the toner becomes too fluid, so that the toner is liable to be passed through the toner-conveying cable 4 like a jet stream to cause flooding of the toner in the toner replenishing tube 5.

The replenishing of a toner from the supply hopper 3 to the developing apparatus is effected by rotation of a supply screw 16 in the toner-conveying cable 4 for a certain period corresponding to a signal from a toner concentration detector. If the apparent density of the toner is below 0.2, residence of the toner on the supply screw 16 becomes insufficient, and as a result, a larger amount of toner than required is supplied to the developing apparatus for a constant period of rotation of the screw. If the apparent density of the toner exceeds 1.5, the toner stays too long on the screw 16, so that the toner-conveying cable is liable to be plugged, and due to an overload thereby, the supply screw is liable to be broken. For these reasons, the apparent density is more preferably 0.25 to 1.0, particularly preferably be 0.3 to 0.8.

The agglomeration degree and apparent density of the toner according to the present invention may be accomplished by selecting and controlling colored resin particles (toner particles) having preferred fluidity, the kind and amount of addition of a fluidity improver as described herein, the particle size distribution of the toner particles, the degree of exposure of a colorant contained in the toner to the toner particle surface (in other words, compatibility of the colorant in the binder resin), and the kind of the colorant.

A color toner according to the present invention may have a volume-average particle size of 11.0 to 14.0μ, preferably 11.7 to 13.5μ, more preferably 11.7 to 13.3μ; a number-basis distribution such that toner particles of 6.35μ or smaller occupies 30% by number or less, preferably 25% by number or less, more preferably 20% by number or less; a volume-basis distribution such that toner particles of 20.2μ or larger occupies 9 wt. % or less, preferably 7 wt. % or less, more preferably 5 wt. % or less.

If the volume-average particle size exceeds 4.0μ and/or particles of 20.2μ or larger exceed 9 wt. %, there arises an increased tendency of roughening of images, blurring of characters or scattering.

The number-basis proportion of toner particles of 6.35μ or smaller (fine powder) is closely connected to degree of scattering and we have a knowledge that a toner containing 30% by number or more of the fine powder causes scattering which is two or more times that encountered with a toner containing 18% by number of the fine powder. The scattering results in soiling of a charging wire, soiling of optical fiber in the toner concentration detector, inoperability of sliding parts due to accumulation of scattered toner and attachment of scattered toner to non-image parts in an electrostatic latent image on the photosensitive drum to cause fog or poor cleaning, thus leading to a remarkable decrease in life of the copying machine.

According to our study, if the amount of scattering becomes two times, the life and the interval of periodical cleaning is noticeably decreased to $\frac{1}{2}$–$\frac{1}{4}$ or even less.

A volume-average particle size of below 11.0μ invites an increase in amount of ultra fine powder at the time of toner production leading to fog and impairment of image quality, and requires much time and energy in the pulverization step in toner production to invite an increase in production cost.

In full-color development, it is preferred that the respective toners of yellow, magenta, cyan and black have substantially the same particle size, particle size distribution, degree of agglomeration, apparent density, triboelectric charge and apparent viscosity in view of the fact that the same image forming process is applied. For this reason, the kind and the amount of addition of the colorant, charge control agent and fluidity improver are appropriately controlled for the respective colors.

The toner and the two-component developer provide especially preferred results when applied to the following developing method (hereinafter referred to as "J/B development").

Referring to FIG. 2, between the developing sleeve 13 and the photosensitive drum 1 having an electrostatic latent image, a bias electric field comprising an AC component and a DC component is applied. In the development region, it is preferred that the carrier on the developing sleeve 13 occupies 1.5–40 vol. %, preferably 2.0–30 vol. %, of the space formed between the developing sleeve 13 and the photosensitive drum 1. The AC component electric field may have a frequency of 1000–3000 Hz, and the peak-to-peak voltage (Vpp) is adjusted to such a value (preferably 1000 to 2500 Vpp) that the electrostatic latent image is not destroyed but the toner is moved between the developing sleeve 13 and the photosensitive drum 1, whereby the toner on the developing sleeve 13 and the toner attached to the surface of the carrier are transferred to the photosensitive drum 1 to develop the latent image. This development system is referred to as the "J/B development" system. In the present invention, the "development region" refers to a region in which the toner is transferred or supplied from the developing sleeve to an electrostatic latent image-bearing member such as the photosensitive drum.

The volume ratio of the carrier in the development region may be calculated as $$(M/h)\times(1/\rho)\times[C/(T+C)],$$

wherein M denotes the coating amount of the developer on a unit area of the developing sleeve (g/cm$^2$), h the height of the space in the developing region, $\rho$ the true density of the carrier (g/cm$^3$), and C/(T+C) the weight percentage (%) of the carrier in the developer on the sleeve.

In a specific embodiment using the toner and the two-component developer according to the present invention, M was 0.02–0.05 g/cm$^2$, h was 0.02–0.05 cm, $\rho$ was 4–5 g/cm$^3$, and C/(T+C) was 85–95%.

The charge of the toner on the developing sleeve in the J/B development may be measured by directly absorbing the developer from the sleeve, separating the toner from the carrier and then introducing the toner to a Faraday gauge. In a case where the developer according to the present invention is used in the J/B development, the toner in the developer on the sleeve may preferably have a charge of −5 to −30 μC/g.

The J/B development provides a high development efficiency and is effective in providing a light and/or compact apparatus, so that it is suitable for providing a compact full-color copying machine. This method also provides images with a high density, little negative development and little fog. When combined with a ferrite carrier coated with a fluorine-containing resin and a styrene-type resin, a color toner according to the present invention may preferably have a triboelectric charge of −5 to −20 μC/g, further preferably −9 to −18 μC/g, still more preferably −10 to −17 μC/g.

The above coated ferrite carrier shows an effect of advantageously promoting the charging characteristic of the color toner in the J/B development.

If the charge is below −5 μC/g, noticeable scattering of the toner from the developing sleeve in the copying apparatus at the time of development, particularly under high temperature-high humidity conditions (e.g., 30° C., 80% RH), so that a practical application becomes difficult.

Figure 3:
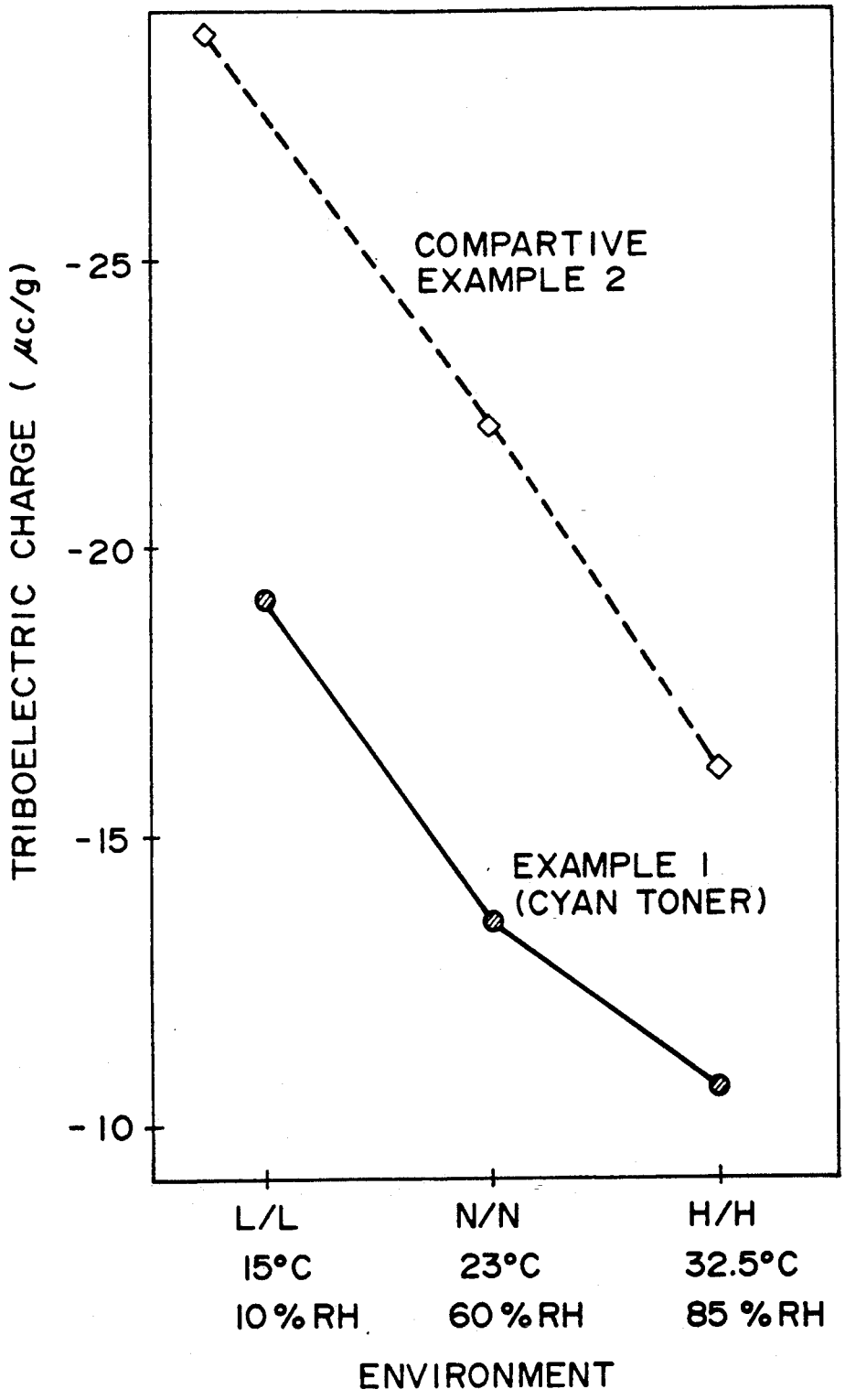
FIG. 3 is a graph showing relations between triboelectric charge and environmental conditions with respect to a cyan toner of Example 1 and a magenta toner of Comparative Example 2 described hereinafter.

If the charge exceeds −20 μC/g, the toner is electrostatically attached too strongly to the carrier surface under substantially normal temperature-low humidity conditions (20° C., 10%RH), so that the transfer of the toner onto the photosensitive member having an electrostatic latent image becomes extremely difficult. FIG. 3 shows the dependency of triboelectric charges of the toners of Example 1 and Comparative Example 1 on environmental conditions.

For a color toner for full-color copying, the fixability of a toner is a very important factor from the viewpoint of color mixing characteristic. Multiple layers of toners are superposed on a transfer support material and subjected to color-mixing through one time of fixing so as to develop various colors depending on coating amounts of the respective toners on the transfer material. Accordingly, if a toner has a poor fixability such that fixed toner particles are discernible under microscopic observation, the fixed toner particles cause random reflection of incident light, thus providing a turbid image with a lower saturation and even leading to a lowering in color reproducibility.

In case where a toner copy is formed on an OHP (overhead projector) film, the copy can provide a dark gray image for a transmissive light while it provides an image of an almost desired color tone for reflection light, when the toner has a poor fixability providing poor transmission characteristics.

However, if only the fixability is considered, other difficulties are liable to occur, such as high temperature offset, wrapping of transfer paper about fixing rollers. If these difficulties are obviated by providing a device for applying a large amount of oil, it leads to complication of the fixing apparatus, increase in cost and even degradation of copied image quality due to trace of oil.

A color toner according to the present invention is ensured with respect to fixability, color-mixing characteristic and resistance to high-temperature offset by having an apparent viscosity at 90° C. of $5\times10^4$ to $5\times10^6$ poise, preferably $7.5\times10^4$ to $2\times10^6$ poise, more preferably $10^5$ to $10^6$ poise, and an apparent viscosity at 100° C. of $10^4$ to $5\times10^5$ poise, preferably $10^4$ to $3.0\times10^5$ poise, more preferably $10^4$ to $2\times10^5$ poise.

It is particularly preferred that the toner has an apparent viscosity at 90° C. of $P_1$ and an apparent viscosity at 100° C. of $P_2$ satisfying the relation of $2\times10^5<|P_2-P_1|<4\times10^6$.

At the same time, the heat-absorption peak value of a toner as measured by DSC (differential scanning calorimetry) has a correlation with the fixability of the toner. Too high a peak value provides a poor fixability, and too low a peak value leads to a problem in storability, particularly toner blocking in a toner bottle during storage at the high temperature encountered in the hold of a ship during surface transportation.

A color toner with sufficient fixability cannot be expected unless the apparent viscosity at 90° C., the apparent viscosity at 100° C. and the absorption peak temperature according to DSC measurement are all satisfied.

It is desired that a color toner according to the present invention has an absorption peak temperature according to DSC in the range of 58°-72° C., preferably 58°-70° C., more preferably 62°-70° C.

In order to accomplish the apparent viscosities at 90° C. and 100° C. and the DSC absorption peak value, it is necessary to scrutinize a monomer composition, monomer species, a crosslinking agent, and a polymerization initiator or a condensation promoter for providing a binder resin and production conditions for producing the binder resin from these components.

In a full-color copying process, the gloss of an image is much more important than in printing or photography in order to provide high quality electrophotographic images.

The toner is required to show a gloss of 5.0% or higher, more preferably 7.0% or higher. A gloss of below 5.0% provides deep and somber images with poor color reproduction and image quality.

The gloss of a toner is closely related with the thermal characteristics of a binder resin and the compatibility of a colorant with the resin. In order to provide a desired gloss, it is necessary to scrutinize the kneading characteristic and dispersibility of toner materials.

The chromaticity of a color toner determines the range of color reproduction. The respective colors of yellow, magenta, cyan and black must be balanced in this respect.

Figure 4:
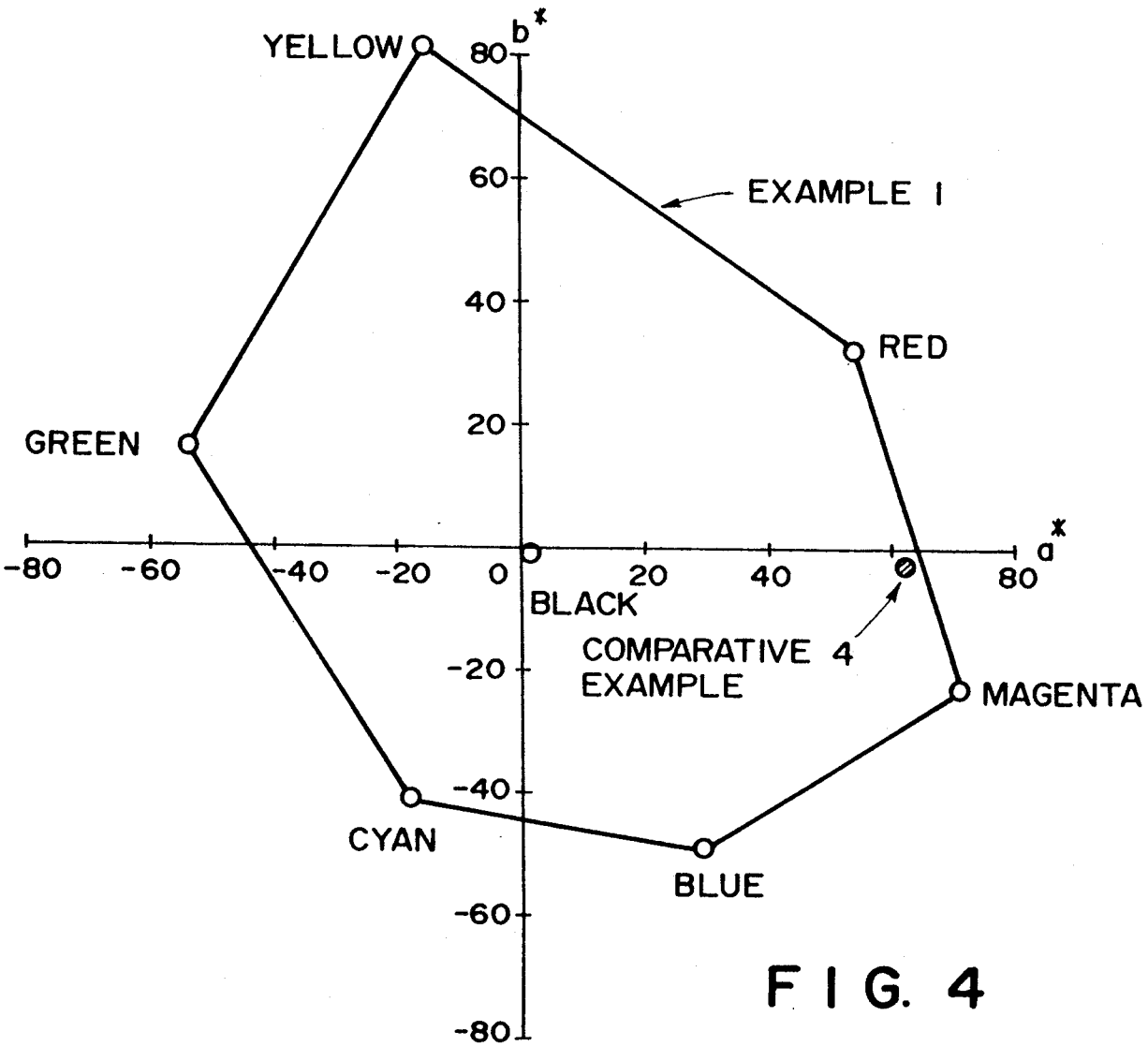
FIG. 4 is a chromaticity diagram showing chromaticities of yellow toner, magenta toner, cyan toner and black toner, chromaticity of red obtained by superposition of the magenta toner and the yellow toner, chromaticity of blue obtained by superposition of the magenta toner and the cyan toner, and chromaticity of green obtained by superposition of the cyan toner and the yellow toner in Example 1 and chromaticity of a magenta toner in Comparative Example 4.

If any of yellow, magenta and cyan toners has an extremely low saturation or a deviation in hue, the latitude of color reproduction is extremely restricted. In such a case, the shape of a color hexagon as shown in FIG. 4 is distorted to narrow the area inside thereof.

Green is obtained by superposition of cyan and yellow toners but is most liable to have a lower saturation when compared with other colors obtained by superposition (e.g., blue and red). For this reason, unless cyan and yellow have chromaticies exceeding a certain level, it is difficult to obtain green with good color tone and saturation.

Thus, colorants have to be selected to provide a saturation as large as possible while taking a color balance into consideration. More specifically, it is desired to select the colorants so that the chromaticity circle shown in FIG. 4 assume a shape close to an orthogonal hexagon and have a maximum area.

In the present invention, each color toner should satisfy the following chromaticity values or coordinates:

Yellow toner a*: −6.5 to −26.5, preferably −11.5 to −21.5; more preferably −12.5 to −20.5;

b*: 73.0 to 93.0, preferably 78.0 to 88.0, more preferably 79.0 to 87.0;

L*: 77.0 to 97.0, preferably 82.0 to 92.0, more preferably 83.0 to 91.0.

Magenta toner a*: 60.0 to 80.0, preferably 65.0 to 75.0, more preferably 66.0 to 74.0;

b*: −12.0 to −32.0, preferably −17.0 to −27.0, more preferably −18.0 to −26.0;

L*: 40.0 to 60.0, preferably 40.0 to 55.0, more preferably 44.0 to 54.0.

Cyan toner a*: −8 to −28.0, preferably −10.0 to −27.0, more preferably −14.0 to −25.0;

b*: −30.0 to −50.0, preferably −33.0 to −45.0, more preferably −35.0 to −44.0;

L*: 39.0 to 59.0, preferably 44.0 to 59.0; more preferably 45.0 to 57.0.

Black toner a*: −3.5 to 6.5, preferably −2.0 to 5.5;

b*: −6.0 to 4.0, preferably −5.0 to 3.0;

L*: 26.0 to 36.0, preferably 27.0 to 35.0.

The respective color toners of the present invention should preferably satisfy the following conditions on the chromaticity diagram.

(i) Angle between cyan and yellow: 145±15°, (ii) Angle between cyan and magenta: 95±15°, (iii) Angle between magenta and yellow: 120±10°.

Herein, the angle between cyan and yellow refers to an angle formed between lines connecting the zero point and the cyan coordinate are the zero point and the yellow coordinate, respectively, on the chromaticity diagram. The angle between cyan and magenta and the angle between magenta and yellow are similarly defined.

The binder resin for a color toner according to the present invention may be selected from the following resins as far as the characteristics of the present invention are retained, styrene-type resins inclusive of homopolymers and copolymers of styrene and its derivatives, such as polystyrene, polychlorostyrene, poly-α-methylstyrene, styrene-chloro-styrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymers (styrene-methyl acrylate copolymer, styrene-ethyl acrylate copolymer, styrene-butyl acrylate copolymer, styrene-octyl acrylate copolymer, styrene-phenyl acrylate copolymer), styrene-methacrylic acid ester copolymers (styrene-methyl methacrylate copolymer, styrene-ethyl methacrylate copolymer, styrene-butyl methacrylate copolymer, styrene-phenyl methacrylate copolymer), styrene-methyl α-chloro-acrylate copolymer, and styrene-acrylonitrile-acrylic acid ester copolymers; vinyl chloride resin, styrene-vinyl acetate copolymer, rosin-modified maleic acid resin, phenolic resin, epoxy resin, polyester resin, low-molecular weight polyethylene, low-molecular weight polypropylene, ionomer resin, polyurethane resin, silicone resin, ketone resin, ethylene-ethyl acrylate copolymer, xylene resin, and polyvinyl butyral resin. For the toner of the present invention, particularly preferred resins may be styrene-acrylic acid ester-type resins, styrene-methacrylic acid ester-type resins, and polyester resins.

In view of sharp melting characteristics, particularly preferred resins may be polyester resins obtained through polycondensation of at least a diol component selected from bisphenol derivatives represented by the formula:

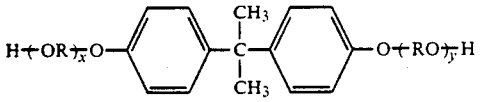

wherein R denotes an ethylene or propylene group; x and y are respectively a positive integer of 1 or more providing the sum (x+y) of 2 to 10 on an average) and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, pyromellitic acid and mixtures thereof).

The carrier used in the present invention may be composed of, e.g., iron or an alloy of iron with nickel, copper, zinc, cobalt, manganese, chromium, and rare earth elements in the surface oxidized form or in the surface non-oxidized form, or of an oxide or ferrite form of these metal or alloys. The production process of the carrier is not particularly limited.

It is preferred to coat the carrier with a resin, etc., particularly in the above-mentioned J/B method. The carrier may be coated with a resin by dipping the carrier in a solution or suspension of a coating material such as a resin or attaching the coating material in powder form to the carrier.

The coating material on the carrier surface may vary depending on the carrier material and may, for example, be polytetrafluoroethylene, monochlorotrifluoroethylene polymer, polyvinylidene fluoride, silicone resin, polyester resin, metal complex of di-tertiarybutylsalicylic acid, styrene-type resin, acrylic resin, polyamide, polyvinylbutyral, nigrosine, aminoacrylate resin. basic dye or its lake, silica fine powder, and alumina fine powder. These coating materials may be used singly or in combination.

The coating amount of the above coating material may be determined so that the resultant carrier satisfies the above-mentioned condition but may generally be in a proportion of 0.1 to 30 wt. %, preferably 0.5–20 wt. %, in total, based on the carrier.

The carrier may have an average particle size of 20–100μ, preferably 25–70μ, more preferably 30–65μ.

The carrier, in its particularly preferred form, may be composed of ternary magnetic ferrite of Cu-Zn-Fe coated with a resin combination, such as that of a fluorine-containing resin and a styrene-type resin. Examples of the combination include polyvinylidene fluoride and styrene-methyl methacrylate resin; and polytetrafluoroethylene and styrene-methyl methacrylate resin. The proportions of the fluorine-containing resin and the styrene-type resin may be 90:10 to 20:80, preferably 70:30 to 30:70. It is preferred to coat the ferrite particles with 0.01 to 5 wt. %, particularly 0.1 to 1 wt. %, of the resin combination. The carrier may preferably have a particle size distribution such that particles in the range of 250 mesh-pass and 350 mesh-on occupy 70 wt. % or more. Mesh sizes referred to herein are based on the Tyler system. A further preferred example of the fluorine-containing resin includes vinylidene fluoride-tetrafluoroethylene copolymer (10:90 to 90:10), and examples of the styrene-type copolymer include styrene-2-ethylhexyl acrylate copolymer (20:80 to 80:20) and styrene—2-ethylhexyl acrylate-methyl methacrylate copolymer (20 to 60:5 to 30:10 to 50).

The coated ferrite carrier satisfying the above conditions has a sharp particle size distribution, provides a preferable triboelectric charge and provides a developer with improved electrophotographic characteristics.

A two-component developer may be prepared by mixing a color toner according to the present invention with a carrier so as to give a toner concentration in the developer of 5.0 wt. %–15 wt. %, preferably 6 wt. % to 13 wt. %, which generally provides good results. A toner concentration of below 5.0% results in a low image density of the obtained toner image, and a toner concentration of above 15% is liable to result in increased fog and scattering of toner in the apparatus and a decrease in life of the developer.

In the present invention, a fluidity improver may be added to the toner comprising colorant-containing resin particles to improve the fluidity or flowability of the toner.

Examples of the fluidity improver may include powder of fluorine-containing resins (polyvinylidene fluoride powder and polytetrafluoroethylene powder), aliphatic acid metal salts (zinc stearate, calcium stearate, lead stearate), metal oxides (zinc oxide powder), fine powder silica (wet-process silica, dry process silica), surface treated product of such silica with silane coupling agent, titanate coupling agent or silicone oil.

A preferred class of fluidity improver may be fine silica powder obtained by vapor phase oxidation of silicon halide, called dry-process silica or fumed silica. Such fine silica powder may, for example, be obtained by pyrolytic oxidation of gaseous silicon tetrachloride in oxygen-hydrogen flame. The basic reaction scheme may be represented as follows:

$$SiCl_4 + 2H_2 + O_2 \rightarrow SiO_2 + 4HCl$$

In the above preparation step, it is also possible to obtain complex fine powder of silica and other metal oxides by using other metal halides such as aluminum chloride or titanium chloride together with silicon halides.

It is preferred to use silica fine powder, of which mean primary particle size is desirably within the range of from 0.001 to 2μ, particularly preferably of from 0.002 to 0.2μ.

Commercially available silica fine powder produced through vapor-phase oxidation of silicon halide to be used in the present invention include those sold under the trade names as shown below.

| | |
|---|---|
| AEROSIL | 130 |
| (Nippon Aerosil K.K.) | 200 |
| | 300 |
| | 380 |
| | TT 600 |
| | MOX170 |
| | MOX 80 |
| | COK 84 |
| Ca-O-Sil | M-5 |
| (Cabot Co.) | MS-7 |
| | MS-75 |
| | HS-5 |
| | EH-5 |
| Wacker HDK N 20 | V-15 |
| (WACKER-CHEMIE GMBH) | N 20E |
| | T 30 |
| | T 40 |
| D-C Fine Silica | |
| (Dow Corning Co.) | |
| Fransol | |
| (Fransil Co.) | |

It is further preferred to use hydrophobic silica fine powder obtained by subjecting the dry-process silica fine powder to a hydrophobicity-imparting treatment. Such hydrophobic silica fine powder having a hydrophobicity of 30–80 as measured by the methanol titration is particularly preferred.

A hydrophobicity-imparting treatment may be effected by treating the silica fine powder with an organosilicon compound capable of reacting with or being physically adsorbed on the silica fine powder.

Example of the organosilicon compound include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, and further dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing each one hydroxyl group bonded to Si at the terminal units and the like. These may be used alone or as a mixture of two or more compounds.

The hydrophobic silica fine powder may preferably have a particle size in the range of 0.003 to 0.1μ. Examples of the commercially available products may include Tullanox-500 (available from Tulco Inc.), and AEROSIL R-972 (Nihon Aerosil K.K.).

The fluidity-improver may be added to the toner in a proportion of 0.01 to 10 wt. parts, preferably 0.1 to 5 wt. parts, per 100 wt. parts of the toner. Below 0.01 wt. part, a substantial effect of fluidity improvement cannot be obtained, and more than 10 wt. parts leads to fog and blurring of images and promotes scattering of the toner in the apparatus.

In the present invention, it is not advisable to use a colorant, such as C.I. Disperse Y 164, C.I. Solvent Y 77 and C.I. Solvent Y 93. Examples of the colorants suitable for the purpose of the present invention may include the following pigments or dyes.

Examples of the dyes may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, and C.I. Mordant Blue 7.

Examples of the pigments may include Naphthol Yellow S, Hansa Yellow G, Permanent Yellow NCG, Permanent Orange GTR, Pyrazolone Orange, Benzidine Orange G, Permanent Red 4R, Watching Red calcium salt, Brilliant Carmine 3B, Fast Violet B, Methyl Violet Lake, Phthalocyanine Blue, Fast Sky Blue, and Indanthrene Blue BC.

Particularly preferred pigments may include disazo yellow pigments, insoluble azo pigments and copper phthalocyanine pigments, and particularly preferred dyes may include basic dyes and oil soluble dyes.

Particularly preferred examples may include: C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, C.I. Pigment Blue 16, copper phthalocyanine pigments having two to three carboxybenzamidomethyl groups, and copper phthalocyanine pigments, represented by the following structural formula (1), which have a phthalocyanine skeleton to which 2–3 carboxybenzamidomethyl group in the form of Ba salts are attached.

(1)

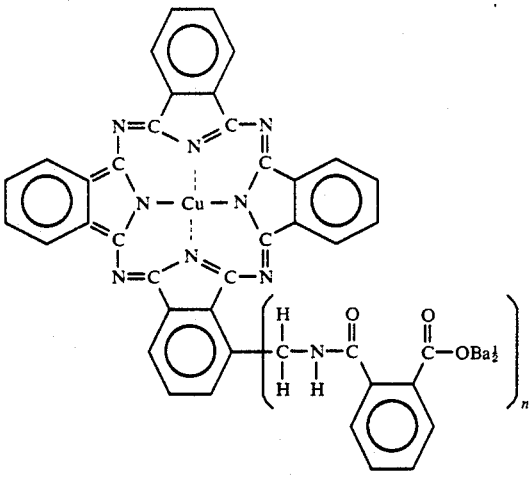

n = 2–3

Particularly preferred examples of dyes may include: C.I. Solvent Red 49, C.I. Solvent Red 52, C.I. Solvent Red 109, C.I. Basic Red 12, C.I. Basic Red 1, and C.I. Basic Red 3B.

As for the content of the colorants, a yellow colorant for providing a yellow toner, which sensitively affects the transparency of an OHP film, may preferably be used in a proportion of 0.1 to 12 wt. parts, more preferably 0.5–7 wt. parts, per 100 wt. parts of the binder resin. A proportion of more than 12. wt. parts provides a poor reproducibility of mixed colors of yellow, such as green, red and skin color.

A magenta colorant and a cyan colorant for providing the magenta and cyan toners, respectively, may preferably be used in a proportion of 0.1 to 15 wt. parts, more preferably 0.1–9 wt. parts, per 100 wt. parts of the binder resin.

In case of a black toner containing two or more colorants in combination, the addition of more than 20 wt. parts in total is liable to cause spending thereof to the carrier and cause the colorants to be exposed on the toner surface, thus inviting increased sticking of the toner onto the photosensitive drum to instabilize the fixability. For this reason, the amount of the colorants in the black toner should preferably be 3 to 15 wt. parts per 100 wt. parts of the binder resin.

A preferred combination of colorants for providing a black toner may be that of a disazo type yellow pigment, a monoazo-type red pigment and a copper phthalocyanine-type blue pigment. The proportional ratios of the yellow pigment, the red pigment and the blue pigment may preferably be 1:1.5 to 2.5:0.5 to 1.5. As for the preferable examples, the disazo-type yellow pigment may be C.I. Pigment Yellow 17 or C.I. Pigment Yellow 13, the monoazo-type red pigment may be C.I. Pigment Red 5 or C.I. Pigment Red 7, and the copper phthalocyanine-type blue pigment may be C.I. Pigment Blue 15.

It is also preferred to add a charge control agent in order to stabilize the negative chargeability to the toner according to the present invention. In this instance, it is preferred to use a colorless or thin-colored negative charge control agent so as not to affect the color tone of the toner. The magnetic charge control agent may for example be an organo-metal complex such as a metal complex of alkyl-substituted salicylic acid (e.g., chromium complex or zinc complex of di-tertiary-butylsalicylic acid). The negative charge control agent may be added to a toner in a proportion of 0.1 to 10 wt. parts, preferably 0.5 to 8 wt. parts, per 100 wt. parts of the binder resin.

Hereinbelow, various methods for measuring the physical properties characterizing the toner according to the present invention are inclusively described.

(1) Particle size distribution

Coulter counter Model TA-II (available from Coulter Electronics Inc.) is used as an instrument for measurement, to which an interface (available from Nikkaki K.K.) for providing a number-basis distribution, a volume-basis distribution, a number-average particle size and a volume-average particle size, and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 0.5 to 50 mg, preferably 2 to 200 mg, of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40μ by using the above-mentioned Coulter counter Model TA-II with a 100 μ-aperture to obtain a volume-basis distribution and a number-basis distribution. From the results of the volume-basis distribution and number-basis distribution, the volume-average particle size, the percentage (%) by number of toner particles having particle sizes of below 6.35μ, and the percentage (%) by weight (i.e., % by volume) of particles having particle sizes of above 20.2μ of the sample toner are calculated.

(2) Agglomeration degree

The agglomeration degree is used as a measure for evaluating the fluidity of a sample (e.g., a toner composition containing a fluidity improver A higher agglomeration degree is judged to represent a poorer fluidity of the sample.

As an instrument for measurement, Powder Tester (available from Hosokawa Micron K.K.) is used.

For measurement, a 60-mesh sieve, a 100 mesh sieve and a 200-mesh sieve are superposed in this order from the above and set on a vibration table. An accurately measured sample in an amount of 5 g is placed on the 60-mesh sieve, and the vibration table is subjected to vibration for about 15 seconds under the conditions of an input voltage to the vibration table of 21.7 V, and a vibration amplitude in the range of 60–90μ (a rheostat scale: about 2.5). The weights of the sample remaining on the respective sieves are measured to calculate the agglomeration from the following equation:

Agglomeration degree (%)

$$=(\text{sample weight on 60-mesh sieve}/5\text{ g})\times 100$$
$$+(\text{sample weight on 100-mesh sieve}/5\text{ g})\times 100\times 3/5$$
$$+(\text{sample weight on 200-mesh sieve}/5\text{ g})\times 100\times 1/5.$$

The sample before the measurement is left standing under the conditions of 23° C. and 63%RH and is subjected to measurement under the conditions of 23° C. and 63%RH.

(3) Apparent density

Powder Tester (available from Hosokawa Micron K.K.) is used for measurement of the apparent density. A 60-mesh sieve is placed on a vibration table, and right under the sieve, a preliminarily weighed 100 cc-cup for measurement of apparent density is placed. Then, vibration is started at a rheostat scale of 2.0. A sample is gently poured on the vibrating 60-mesh sieve so as to pass through the sieve into the cup. When the cup is filled with a heap of the sample, the vibration is terminated and the heap of the sample is leveled at the top of the cup. Then, the sample is weighed accurately by a balance.

As the inner volume of the cup for measurement is 100 cc, the apparent density (g/cc) of the sample is obtained as the sample weight (g)/100.

The sample before the measurement is left standing under the conditions of 23° C. and 63%RH and is subjected to measurement under the conditions of 23° C. and 63%RH.

(4) Apparent viscosity

Flow Tester Model CFT-500 (available from Shimazu Seisakusho K.K.) is used. Powder having passed through a 60-mesh sieve is used as a sample and weighed in about 1.0 to 1.5 g. The sample is pressed under a pressure of 100 kg/cm$^2$ for 1 minute by using a tablet shaper.

The pressed sample is subjected to measurement by means of Flow Tester in an environment of temperature of about 20° to 30° C. and relative humidity of 30–70% under the following conditions:

| | |
|---|---|
| RATE TEMP | 6.0 D/M (°C./min) |
| SET TEMP | 70.0 DEG (°C.) |
| MAX TEMP | 200.0 DEG |
| INTERVAL | 3.0 DEG |
| PREHEAT | 300.0 SEC |
| LOAD | 20.0 KGF (kg) |
| DIE (DIA) | 1.0 MM (mm) |
| DIE (LENG) | 1.0 MM |
| PLUNGER | 1.0 CM$^2$ (cm$^2$) |

From the resultant Temperature-Apparent viscosity curve, the apparent viscosities of the sample at 90° C. and 100° C. are read and recorded.

(5) Chromaticity

Totally 7 colors of solid image samples are prepared, including yellow, magenta, cyan, black, red (superposition of magenta and yellow), blue (superposition of magenta and cyan), and green (superposition of cyan and yellow), on plain paper such as sunflower paper as a transfer paper. The solid images in the respective colors are adjusted to have an image density in the range of 1.5±0.2 according to measurement by a reflection densitometer (preferably Model RD-914 available from McBeth Co.)

Such solid images may for example be obtained by using a laser color copying machine (available from Canon K.K.) under set conditions of a toner concentration of 9–10% for each of yellow, magenta, cyan and black and a potential contrast of 150–250 V and environmental conditions of 23° C., 60%RH.

These solid images are subjected to measurement of spectral reflectances in the range of 390–730 nm by using a high-speed spectral luminance meter (available from Murakami Shikisai Kenkyusho K.K.).

Then, the tristimulus values of X, Y and Z of each solid image sample are measured according to JIS Z-8722 "Method of Measurement for Colour of Materials Based on the CIE 1931 Standard Colorimetric System", and chromaticity values or coordinates (a*, b* and L*) are obtained from the tristimulus values.

More specifically, the stimulus values X, Y and Z are obtained by using specified achromatic light-C as the light source, a two-degree field for the color matching function and the spectral reflectances of the sample in the range of 390–730 nm at an interval of 10 nm based on the following equations:

$$X = \sum_{390}^{730} R(\lambda) \cdot S(\lambda) \cdot \bar{x}(\lambda)$$

$$Y = \sum_{390}^{730} R(\lambda) \cdot S(\lambda) \cdot \bar{y}(\lambda)$$

$$Z = \sum_{390}^{730} R(\lambda) \cdot S(\lambda) \cdot \bar{z}(\lambda)$$

wherein S(λ) represents the C light source, x(λ), y(λ) and z(λ) represent color matching functions, and R(λ) represents a spectral reflectance.

From the X, Y and Z values, these chromaticities (a*, b*, L*) are obtained from the following equations:

$$a^* = 500[(X/X_0)^{\frac{1}{3}} - (Y/Y_0)^{\frac{1}{3}}]$$

$$b^* = 200[(Y/Y_0)^{\frac{1}{3}} - (Z/Z_0)^{\frac{1}{3}}]$$

$$L^* = 116(Y/Y_0)^{\frac{1}{3}} - 16$$

wherein $X_0$, $Y_0$ and Z0 respectively denote the stimulus values of the light source color and are represented by the following equations:

$$X_0 = \sum_{390}^{730} S(\lambda) \cdot \bar{x}(\lambda)$$

$$Y_0 = \sum_{390}^{730} S(\lambda) \cdot \bar{y}(\lambda)$$

$$Z_0 = \sum_{390}^{730} S(\lambda) \cdot \bar{z}(\lambda)$$

(6) Heat-adsorption peaks according to DSC

DSC stands for differential scanning colorimetry.

A differential scanning calorimeter DSC 7 (available from Perkin Elmer Corp.) is used.

A sample is accurately weighed in 5–20 mg, preferably about 10 mg. The sample is placed on an aluminum pan with the use of an empty aluminum pan as the reference and is subjected to DSC in the temperature range of 30° C. to 200° C. at a temperature raising rate of 10° C./min in the environment of normal temperature and normal humidity. The absorption peak referred to herein is a temperature at which a main absorption peak is observed in the temperature range of 40°–100° C.

(7) Triboelectric charge

Figure 6:
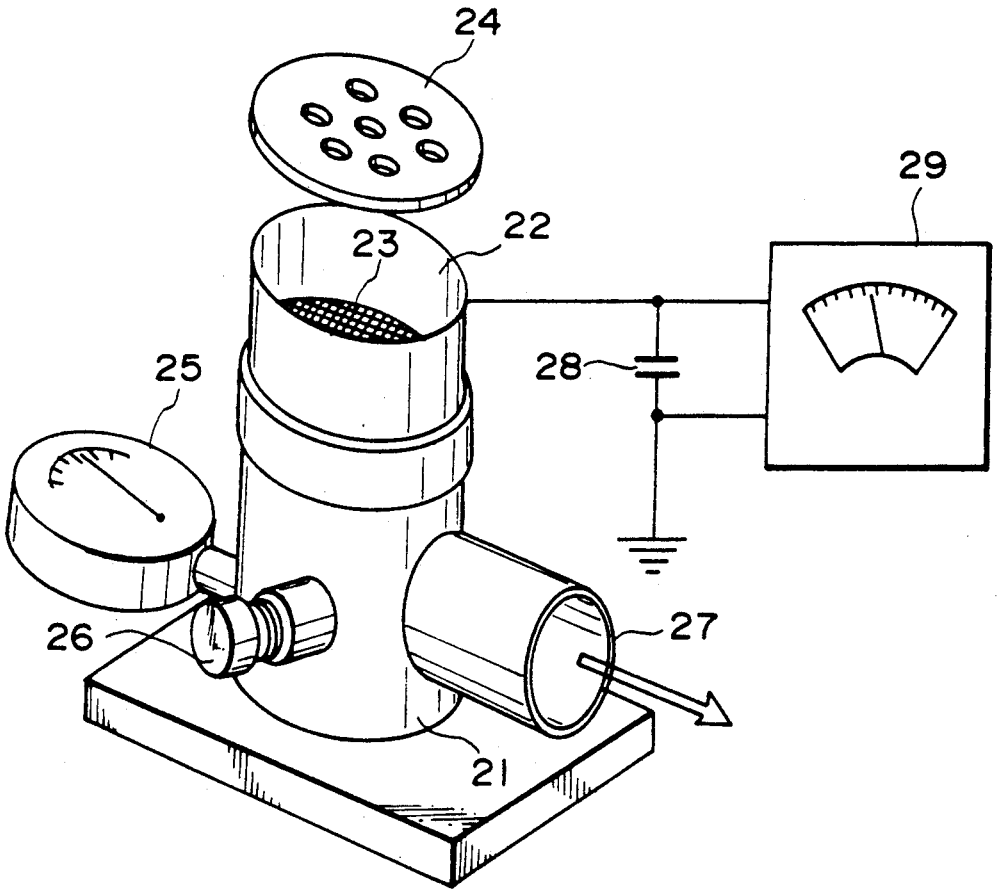
FIG. 6 is a schematic perspective view of an apparatus for measuring the triboelectric charge of a toner.

An instrument as shown in FIG. 6 is used, for measurement of a triboelectric charge of a toner. A mixture of a sample toner for measurement of triboelectric charge and a carrier in a mixing weight ratio of 1:9 is charged in a polyethylene bottle with a volume of 50–100 ml and shaked by hands for about 10–40 seconds. Then, about 0.5 to 1.5 g of the shaked mixture (developer) is charged in a metal container 22 for measurement provided with a 500-mesh screen 23 at the bottom as shown in FIG. 6 and covered with a metal lid 24. The total weight of the container 22 is weighed and denoted by $W_1$ (g). Then, an aspirator 21 composed of an insulating material at least with respect to a part contacting the container 22 is operated, and the toner in the container is removed by suction through a suction port 27 sufficiently (preferably for about two minutes) while controlling the pressure at a vacuum gauge 25 at 250 mm.Aq. by adjusting an aspiration control valve 26. The reading at this time of a potential meter 29 connected to the container by the medium of a capacitor having a capacitance C (μF) is denoted by V (volts). The total weight of the container after the aspiration is measured and denoted by $W_2$ (g). Then, the triboelectric charge (μC/g) of the toner is calculated as: $C \times V/(W_1 - W_2)$ The carrier used for the measurement is a ferrite carrier coated with fluorine containing resin-styrene type resin and comprises 70 wt. % or more, preferably 75–95 wt. %, of particles having sizes between 250 to 350 mesh. More specifically, the carrier is a ferrite carrier coated with 0.2–0.7 wt. % of a 5:5 mixture of vinylidene fluoride-tetrafluoroethylene copolymer and styrene-2-ethylhexyl acrylate-methyl methacrylate copolymer.

The sample (toner or toner composition) and the carrier used for the measurement are left standing for at least 12 hours in the environment of 23° C. and 60%RH before the measurement. The measurement of triboelectric charge is also conducted in the environment of 23° C. and 60%RH.

(8) Gloss

A gloss meter Model $V_G$-10 (available from Nihon Denshoku K.K.) is used. The solid color images used for measurement of chromaticity are also used herein.

For measurement, a voltage of 6 volts is supplied to the gloss meter from a constant-voltage power supply, and the light-projecting angle and the light-receiving angle are respectively set to 60°.

Zero point adjustment and standard adjustment are conducted by using a standard plate. Then, measurement is conducted by placing a sample image on the sample table, and further by superposing thereon three sheets of white paper. The values indicated on the display are read in % units. At this time, the S - S/10 changeover switch is set to the S side and the angle-sensitivity changeover switch is set to 45–60.

For measurement, samples having an image density in the range of 1.5±0.1 are used.

(9) Spectral reflectance

Yet non-fixed images after transfer are measured. Thus, the reflectances from toner particles constituting the yet non-fixed images on the transfer material are measured.

A spectrophotometer DK-2A (available from Beckman Instruments Inc.) is used to measure spectral reflectances in the range of 700–1050 nm.

A toner concentration in a developer is detected by measuring and comparing the reflectances of toner particles of each color and the carrier in the near infrared region.

(10) Hydrophobicity

The hydrophobicity of silica fine powder having a surface imparted with a hydrophobicity is measured by the methanol titration test, which is conducted as follows.

Sample silica fine powder (0.2 g) is charged into 50 ml of water in a 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol on reaching the end point.

The toner kit according to the present invention may be formed as a set of the respective color toners each contained in a separate toner container, such as a bottle, adapted for storage, or may be formed as a set of the four color toners supplied in a copying machine. Further, the full-color toner kit may be formed as a set of the respective color toners of magenta, cyan, yellow and black separately charged in 4 chambers in a single toner container. In any case, the full-color toner kit according to the invention is finally formed as a set of four color toners in a full-color copying machine.

Hereinbelow the present invention is more specifically explained with reference to specific Examples and Comparative Examples.

EXAMPLE 1

Four color toners were prepared by adding colorants and charge control agent shown in the following table in the indicated proportions respectively to 100 wt. parts of a polyester resin obtained by condensation of propoxidized bisphenol and humaric acid.

| Toner | Colorant Name | Colorant wt. parts | wt. parts of charge control agent *1 |
|---|---|---|---|
| Yellow | C.I. Pigment Yellow 17 | 3.5 | 4.0 |
| Magenta | C.I. Solvent Red 52 | 1.0 | 4.0 |
| | C.I. Solvent Red 49 | 0.9 | |
| Cyan | Phthalocyanine pigment *2 | 5.0 | 4.4 |
| Black | C.I. Pigment Yellow 17 | 1.2 | |
| | C.I. Pigment Red 5 | 2.8 | |
| | C.I. Pigment Blue 15 | 1.5 | 4.4 |

*1Chromium-containing organic complex
*2One represented by the formula (1) described before (n = 2)
In the chromaticity diagram, the cyan toner and the yellow toner formed an angle of 146.5°, the cyan toner and the magenta toner formed 95.5°, and the magenta toner and the yellow toner formed 118°.

Each color toner was prepared in the following manner. A mixture containing the above ingredients in the prescribed amounts was sufficiently pre-mixed by means of a Henschel mixer and then melt-kneaded on a three-roll mill at least two times. After cooling, the kneaded product was coarsely crushed to about 1–2 mm by using a hammer mill and then finely pulverized particle sizes below 40 μm by means of a pulverizer based on an air-jet system. The fine pulverized product was classified to provide the particle size distribution according to the present invention mainly by selecting 2 to 23μ. The classified product in an amount of 100 wt. parts was externally mixed with 0.5 wt: part of hydrophobic silica fine powder (hydrophobicity=65) treated with hexamethyldisilazane, as a fluidity improver, to obtain a color toner.

The color toner in an amount of 8–12 wt. parts was mixed with a Cu-Zn-Fe-basis ferrite carrier coated with about 0.5 wt. % of a 50:50 (wt)-mixture of vinylidene fluoride-tetrafluoroethylene copolymer (copolymerization weight ratio=8:2) and styrene-2-ethylhexyl acrylate-methyl methacrylate copolymer (copolymerization weight ratio=45:20:35) so a to provide a total amount of 100 wt. parts, whereby a two-component developer was prepared.

In the above-described manner, four developers respectively containing toners of four different colors, i.e., yellow, magenta, cyan and black, were prepared. In consideration of color-reproduction characteristic and toner-scattering, the concentrations of the toners of yellow, magenta, cyan and black in the developers were made 9 wt. %, 8 wt. % 10. wt % and 10 wt. %, respectively.

Figure 5:
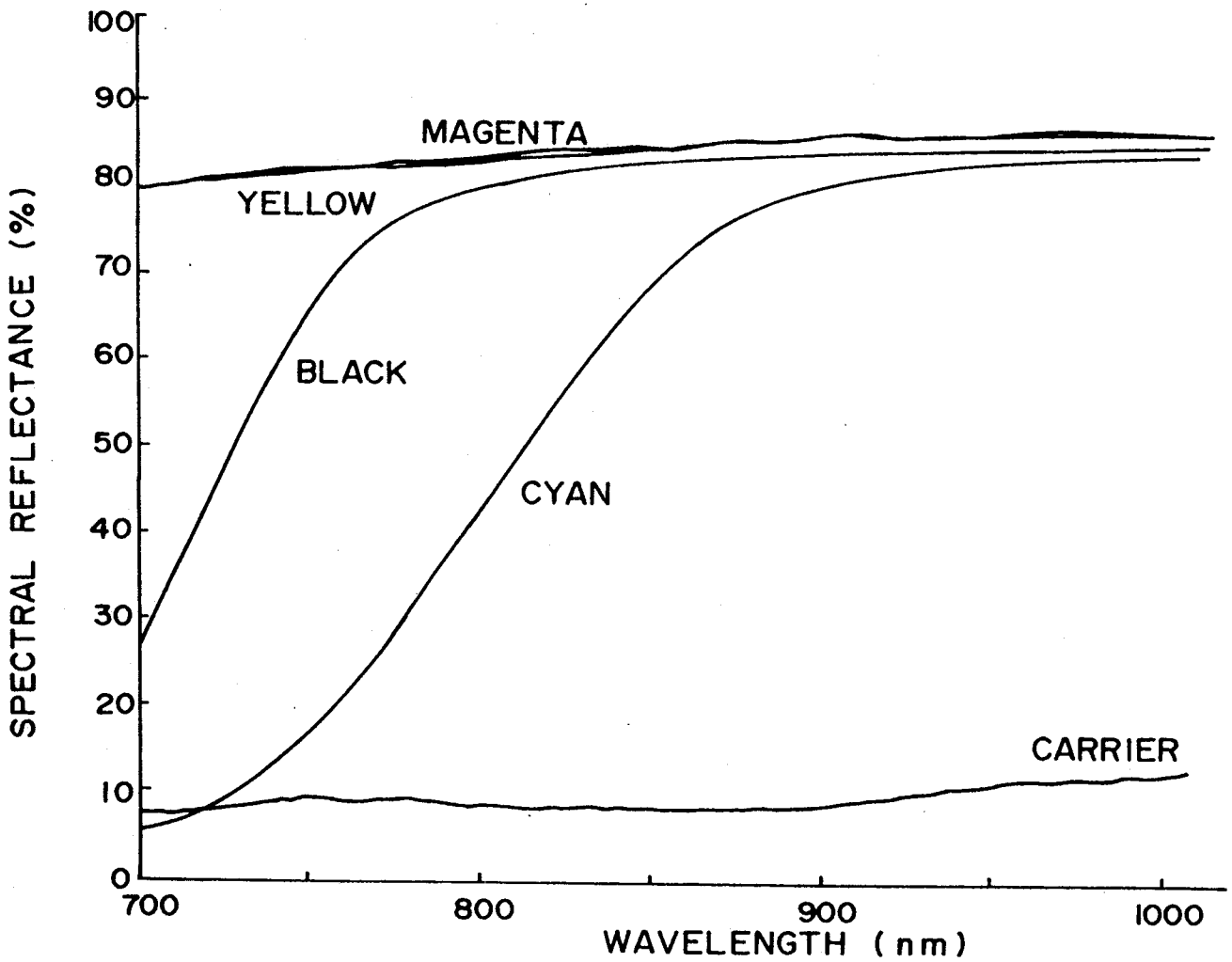
FIG. 5 is a graph showing the spectral reflectances of the respective toners and the carrier used in Example 1.

The spectral reflectances in the near infrared region of these color toners and the coated carrier are shown in FIG. 5. FIG. 5 shows that a large difference in spectral reflectance is observed in the region of 900–1000 nm.

A copying test was conducted by using a color electrophotography apparatus provided with a replenishing-development system and having an OPC photosensitive drum as shown in FIGS. 1 and 2. The test was conducted while applying a bias of 200 Hz, 1800 Vpp between the photosensitive drum 1 and the nonmagnetic metal sleeve 13.

The development and transfer of the respective color toners were effected in the order of the magenta toner, cyan toner, yellow toner, and black toner. The current for transfer applied to the transfer corona charger was 200 mA for the magenta toner, 250 mA for the cyan toner, 300 mA for the yellow toner and 150 mA for the black toner.

A replenishing toner suppied by the supply screw 16 in the toner-conveying cable 4 was supplied to the developing apparatus 2-2 through the toner supply port 15 connected to the developing apparatus. When the developing apparatus was rotated to arrive at a position oppoiste to the photosensitive drum 1, the replenished toner was uniformly mixed in a very short instant with the developer already contained in the developing apparatus by the action of the mixing and conveying screw 12, to form a two-component developer with a constant toner concentration. The developer was supplied to the developing sleeve in a colorant amount by the developer regulating blade 14, and the negatively charged toner therein was transferred to the photosensitive drum 1 having a negatively charged electrostatic latent image through reversal development based on the J/B development method at a position where the developing sleeve 13 and the photosensitive drum were opposite to each other. In this example, the distance between the sleeve and the photosensitive drum was set to 450μ in the development region.

By using the above method, full-color images free of fog and faithfully reproducing an original color chart were obtained even after $1.5\times10^4$ sheets of successive copying in a full-color mode. The conveying of toner and detection of the toner concentration in the developer in the copying machine were well conducted to provide a stable image density. Even in case of copying on an OHP film, the transparency of the resultant toner image was also very good.

The triboelectric charges of the yellow, magenta, cyan and black toners were −15.8 μC/g, −15.0 μC/g, −13.5 μC/g and −16.1 μC/g, respectively. FIG. 3 shows the dependency of the triboelectric charge of the cyan toner on the environments.

Several parameters for the respective developers in the development region in this example were measured as follows.

| Developer | Coating rate (mg/cm²) | C/(T + C) (%) | Triboelectric charge of toner on the sleeve (μC/g) |
|---|---|---|---|
| Yellow | 35.2 | 91.1 | −19.3 |
| Magenta | 33.4 | 92.1 | −15.2 |
| Cyan | 33.8 | 90.2 | −16.6 |
| Black | 34.1 | 89.9 | −17.7 |

FIG. 4 shows a chromaticity diagram obtained at this time, and the Table 1 given below shows the chromaticity values and gloss values for the respective color toners.

Further, the respective color toners shows the apparent viscosities at 90° C. and 100° C. and DSC heat-absorption peaks as shown in Table 2 below, and particle size distribution agglomeration degree and apparent density as shown in Table 3 below.

TABLE 1

| Toner | Chromaticity a* | b* | L* | Gloss |
|---|---|---|---|---|
| Yellow | −16.0 | 82.0 | 87.0 | 7.5% |
| Magenta | 71.0 | −23.0 | 50.0 | 16.1 |
| Cyan | −18.0 | −41.0 | 49.0 | 10.8 |
| Black | 1.0 | −1.0 | 31.0 | 12.3 |

TABLE 2

| Toner | Item: Apparent viscosity at 90°C. | Apparent viscosity at 100° C. | DSC absorption peak |
|---|---|---|---|
| Yellow | $9.0\times10^5$ | $9.0\times10^4$ | 66.8° C. |
| Magenta | $5.2\times10^5$ | $5.3\times10^4$ | 67.7 |
| Cyan | $6.0\times10^5$ | $1.1\times10^4$ | 67.2 |
| Black | $7.1\times10^5$ | $4.8\times10^4$ | 67.1 |

TABLE 3

| Toner | Item: Particle size distribution: Volume average (μ) | Below 6.35μ (% by No.) | Above 20.2μ (% by wt.) | Agglomeration degree (%) | Apparent density (g/cm³) |
|---|---|---|---|---|---|
| Yellow | 12.7 | 19.7 | 1.4 | 5.7 | 0.52 |
| Magenta | 12.4 | 13.1 | 1.2 | 4.6 | 0.41 |
| Cyan | 12.9 | 16.4 | 1.2 | 3.2 | 0.60 |
| Black | 12.8 | 15.6 | 1.6 | 7.1 | 0.58 |

EXAMPLE 2

Example 1 was repeated except that the colorants for magenta were replaced by 0.8 wt. part of C.I. Basic Red 12 and 0.2 wt. part of C.I. Disperse Violet 32. As a result of a successive copying test conducted in the same manner as in Example 1, good images free of sweeping traces were obtained even after $2.0\times10^4$ sheets of copying. The parameters of the magenta toner are shown in Table 4 (Tables 4-1 to 4-4).

EXAMPLE 3

Example 1 was repeated except that the colorant for cyan was changed to 6.0 wt. parts of C.I. Pigment Blue 15, and the colorant for yellow was changed to 2.3 wt. parts of C.I. Disperse Yellow 54. As a result of the copying test conducted in the same manner as in Example 1, preferable images free of fog and with good color balance were obtained. The parameters of the cyan and yellow toners are shown in Table 4.

EXAMPLE 4

Example 1 was repeated except that the colorant for yellow was changed to 4.6 wt. parts of C.I. Pigment Yellow 13. As a result of the test conducted in the same manner as in Example 1, good conveying characteristics under successive copying and satisfactory mixing characteristic of the developer were observed. The parameters of the yellow toner are shown in Table 4.

EXAMPLE 5

Example 1 was repeated except that the colorants for black were changed to the following prescription:

| | |
|---|---|
| C.I. Pigment Blue 15 | 1.4 wt. parts |
| C.I. Basic Red 1 | 1.8 wt. parts |
| Valifast Yellow 3120 | 1.5 wt. parts |

A successive copying test for $1.0\times10^4$ sheets was conducted in the same manner as in Example 1. The accuracy of detection of toner concentration in the developer was sufficient for practical use.

The parameters of the black toner are shown in Table 4.

COMPARATIVE EXAMPLE 1

Example 1 was repeated except that the colorants of black was replaced by only 7.5 wt. parts of carbon black. As a result of a test conducted in the same manner as in Example 1, the resultant images contained noticeable density irregularities and were not practically acceptable, because the black toner showed a spectral reflectance of 10% or below to make the detection of the toner concentration unstable.

COMPARATIVE EXAMPLE 2

Example 1 was repeated except that the colorants for magenta were replaced by 4.0 wt. parts of C.I. Lithol Rubine pigment 57 and the content of the chromium-containing organic complex was changed to 10 wt. parts. As a result, the resultant images were poor in color-reproducibility and showed a low saturation.

During the successive copying, the toner was spent to the carrier to lower the triboelectric charge, whereby the scattering of the toner in the apparatus became intense and the optical fiber for detection of toner concentration was soiled to cause a detection failure on copying of $0.8\times10^4$ sheets.

An extensive charge up (excessive charge) of the toner with the carrier was observed under low temperature-low humidity conditions to provide a considerably low image density of below 0.8 as measured by a McBeth reflection densitometer.

COMPARATIVE EXAMPLE 3

Example 1 was repeated except that the cyan toner was caused to have a broader particle size distribution than defined by the present invention such that the volume-average particle size was 14.5μ, particles having sizes below 6.35μ occupied 35% by number and particles having sizes above 20.2μ occupied 7.0% by weight. As a result of a successive full-color copying test conducted in the same manner as in Example 1, the cyan toner caused scattering in the machine leading to staining on the back of transfer paper and soiling of optical fiber for detecting toner concentration on copying of $0.2\times10^4$ sheets.

COMPARATIVE EXAMPLE 4

Example 1 was repeated except that the colorants for magenta were changed to 2.6 wt. parts of C.I. Rithol Rubine pigment 57. The resultant images were poor in color-reproduction with a low saturation. The magenta toner showed chromaticity values a* of 62, b* of −3 and L* of 22 which are all outside the ranges specified by the present invention.

The parameters of toners used in Comparative Examples 1–4 are also shown in the following Table 4 (Tables 4-1 to 4-4).

TABLE 4

| | Item | | | | | | | | |
|---|---|---|---|---|---|---|---|---|---|
| | Particle size distribution | | | Agglomeration degree | Apparent density | Apparent viscosity (poise) | | DSC absorption | Gloss |
| | Volume-average (μ) | Below 6.35μ (%) | Above 20.2μ (%) | (%) | (g/cm³) | at 90° C. | at 100° C. | peak (°C.) | (%) |
| Example 2 | Magenta toner 13.2 | 19.5 | 4.8 | 8.2 | 0.5 | $3.6\times10^5$ | $3.2\times10^4$ | 61 | 12.3 |
| Example 3 | Cyan toner 12.1 | 17.0 | 2.0 | 4.3 | 0.35 | $7.8\times10^5$ | $4.1\times10^4$ | 64 | 6.2 |
| | Yellow toner 13.2 | 14.0 | 1.5 | 6.7 | 0.41 | $1.2\times10^6$ | $7.8\times10^4$ | 67 | 13.0 |
| Example 4 | Yellow toner 12.8 | 12.1 | 1.7 | 3.2 | 0.43 | $6.2\times10^5$ | $2.0\times10^4$ | 59 | 18.0 |
| Example 5 | Black toner 12.7 | 16.4 | 1.9 | 7.1 | 0.62 | $8.1\times10^5$ | $7.3\times10^4$ | 63 | 6.8 |
| Comparative Example 1 | Black toner 11.2 | 18.0 | 3.2 | 3.1 | 0.59 | $6.3\times10^5$ | $4.7\times10^4$ | 68 | 11.0 |
| Comparative Example 2 | Magenta toner 12.3 | 15.3 | 1.9 | 5.8 | 0.25 | $5.3\times10^5$ | $3.1\times10^4$ | 64 | 11.0 |
| Comparative Example 3 | Cyan toner 14.5 | 35.0 | 7.0 | 30.8 | 0.95 | $5.1\times10^5$ | $1.9\times10^4$ | 66.2 | 9.3 |

| | Triboelectric charge | chromaticity | | | Number of copied sheets | | Density | Scattering | |
|---|---|---|---|---|---|---|---|---|---|
| | (μC/g) | a* | b* | L* | (× 10⁴) | Fog | | | Others |
| Example 2 | −12.5 | 68.0 | −25.0 | 52.0 | 2.0 | ○ | ○ | ○ | |
| Example 3 | −11.0 | −20.0 | −38 | 50 | 1.5 | ○ | ○ | ○ | |
| | −16.3 | −15.5 | 85 | 85 | | | | | |
| Example 4 | −9.8 | −17.5 | 81.0 | 86 | 1.5 | ○Δ | ○ | ○Δ | |
| Example 5 | −14.1 | 1.0 | 0 | 32 | 1.0 | ○ | ○ | ○ | |
| Comparative Example 1 | −17.8 | 1.1 | −2.0 | 38 | 1.5 | x | Δx | x | Density irregularity x |

TABLE 4-continued

| | | | | | | | | | | |
|---|---|---|---|---|---|---|---|---|---|---|
| Comparative Example 2 | −22.0 | 57 | 3 | 20 | 0.8 | — | x | x | Charge-up<br>Color-reproduction | x |
| Comparative Example 3 | −6.8 | −18.3 | −40.0 | 47.0 | 0.2 | Δx | Δ | x | Staining on transfer paper x | |

Note:
<: good.
<Δ: almost good.
Δ: fair (acceptable for practical use).
Δx: not good (not acceptable for practical use).
x: bad.

COMPARATIVE EXAMPLE 4

A cyan toner was prepared in the same manner as in Example 1 except for using styrene-butyl methacrylate copolymer having an apparent viscosity at 90° C. of above $5\times10^6$ and an apparent viscosity at 100° C. of above $5\times10^5$ (weight-average molecular weight: about 78000; apparent viscosity at 110° C.: $1.5\times10^6$ poise, apparent viscosity at 120° C.: $2.8\times10^5$ poise).

The thus obtained cyan toner was combined with the yellow toner to provide a green color. The results are shown in the following Table together with those obtained in Example 1.

| | Example 1 | Comparative Example 4 |
|---|---|---|
| Gloss | 10.2% | 3.0% |
| Chromaticity | | |
| a* | −54.3 | −35.0 |
| b* | 16.1 | 16.1 |
| L* | 40.0 | 40.0 |

Thus, only a green color with a low gloss of 3.0% and in a dark tone was obtained.

The cyan toner was further combined with the yellow toner and the magenta toner to carry out copying of multi-color images, but the latitude of color reproduction was narrow.

COMPARATIVE EXAMPLE 5

A magenta toner was prepared in the same manner as in Example 1 except for using styrene-2-ethylhexyl acrylate-methyl methacrylate copolymer (weight-average molecular weight=25000) having a DSC heat-absorption peak at 53° C.

The resultant magenta toner was liable to cause blocking in the replenishing hopper, was liable to soil or stain the surface of the developing sleeve 13 and could not stable produce magenta toner images under copying on a large number of sheets.

COMPARATIVE EXAMPLE 6

A magenta toner was prepared in the same manner as in Example except for using a highly crosslinked polyester resin having a DSC heat-absorption peak at 76° C. The resultant toner was poor in color-mixing characteristic with the other color toners, and showed a poorer color-reproduction characteristic than the magenta toner of Example 1.

What is claimed is:

1. A black developer for developing electrostatic latent images, comprising: (1d) a black toner composition containing a black toner which in turn contains at least a binder resin and two or more colorants, and hydrophobic silica fine powder and (2d) a ferrite carrier coated with a mixture of a fluorine-containing resin and a styrene type resin in a weight ratio of 90:10 to 20:80, wherein the binder resin comprises a styrene-arcylic acid ester type resin or a polyester ester, the ferrite carrier has an average particle size of 30–60 microns, and the ferrite carrier is coated with 0.01 to 5 wt. % based on the carrier of the mixture of the fluorine-containing resin and the styrene type resin;

the black toner having a volume particle size of 11.0 to 14.0 microns, containing 30% by number or less of particles having sizes below 6.35 microns and containing 9% by weight or less of particles having sizes above 20.2 microns;

the black toner composition having an agglomeration degree of 25% or below and an apparent density of 0.2 to 1.5 g/cm$^3$;

the black toner having an apparent viscosity of 100° C. of $10^4$ to $5\times10^5$ poise, an apparent viscosity of 90° C. of $5\times10^4$ to $5\times10^6$ poise, a DSC heat-absorption peak at 58° to 72° C., and a gloss of 5.0% or higher;

the black toner having chromatically values of a*=−3.5 to 6.5, b*=−6.0 to 4.0, and L*=26.0 to 36.0;

the black toner showing a triboelectric charge of −5 to −20 micro-C/g with respect to the ferrite carrier coated with the mixture of the fluorine-containing resin and the styrene type resin containing 70 wt. % or more of carrier particles having sizes of 250 mesh-pass and 350 mesh-on and the black toner having a spectral reflectance of 60% or more in an infrared region of 900 to 1,000 nm.

2. A black developer according to claim 1, wherein the binder resin comprises a polyester formed from a di- or more-functional carboxylic acid and a bisphenol derivative represented by the formula:

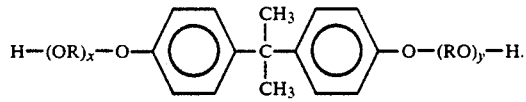

wherein R denotes an ethylene or propylene group; x and y are respectively a positive integer of 1 or more providing the sum (x+y) of 2 to 10 on an average.

3. A black developer according to claim 2, wherein the carboxylic acid is selected from the group consisting of fumaric acid, maleic acid, maleic anhydride, phthalic acid, terephthalic acid, trimellitic acid, pyromellitic acid and mixture thereof.

4. A black developer according to claim 1, wherein the colorants comprise a disazo-type yellow pigment, a monoazo-type red pigment and a phthalocyanine-type blue pigment.

5. A black developer according to claim 4, wherein the disazo-type yellow pigment, the monoazo-type red pigment and the phthalocyanine-type blue pigment are mixed in weight ratios of 1:1.5 to 2.5:0.5 to 1.5.

6. A black developer according to claim 5, wherein the disazo-type yellow pigment is C.I. Pigment Yellow 17 to 13; the monoazo-type red pigment is C.I. Pigment Red 5 or 7; and phthalocyanine-type blue pigment is C.I. Pigment Blue 15.

7. A black developer according to claim 1, wherein the hydrophobic silica fine powder has a hydrophobicity of 30 to 80 as measured by the methanol titration test.

8. A black developer according to claim 1, wherein the hydrophobic silica fine powder is contained in a proportion of 0.01 to 10 wt. parts per 100 wt. parts of the toner.

9. A black developer according to claim 8, wherein the hydrophobic silica fine powder is contained in a proportion of 0.01 to 5 wt. parts per 100 wt. parts of the toner.

10. A black developer according to claim 1, wherein the black toner has a volume-average particle size of 11.5 to 13.5 microns, contains 25% by number or less of particles having sizes below 6.35 microns and contains 7% by weight or less of particles having sizes about 20.2 microns;

the black toner composition has an agglomeration degree of 1.0 to 2.0%, and an apparent density of 0.25 to 1.0 g/cm$^3$;

the black toner has an apparent viscosity at 90° C. of $7.5\times10^{10}$ to $2\times10^6$ poise, and an apparent viscosity at 100° C. of $10^4$ to $3.0\times10^5$ poise; and the black toner has chromaticity values of $a^*=-2.0$ to 5.5, $b^*=-5.0$ to 3.0, and $L^*=27.0$ to 35.0.

11. A black developer according to claim 10, wherein the black toner has a volume-average particle size of 11.7 to 13.3 microns, contains 20% by number or less of particles having sizes below 6.35 microns and contains 5% weight or less of particles having sizes above 20.2 microns;

the black toner composition has an agglomeration degree of 1.0 to 10%, and an apparent density of 0.3 to 0.8 g/cm$^3$;

the toner has an apparent viscosity at 90° C. of $10^5$ to $10^6$ poise, and an apparent viscosity at 100° C. of $10^4$ to $2\times10^5$ poise.

12. A black developer according to claim 1, wherein the ferrite carrier is coated with 0.1 to 1 wt. % based on the carrier of the mixture of the fluorine containing resin and the styrene type resin.

13. A black developer according to claim 1, wherein the fluorine-containing resin and the styrene type resin are mixed in a weight ratio of 70:30 to 30:70.

14. A black developer according to claim 1, wherein the fluorine-containing resin is polyvinylidene fluoride, polytetrafluoroethylene or vinylidene fluoride-tetrafluoroethylene copolymer, and the styrene-type resin is styrene-methyl methacrylate copolymer, styrene-2-ethylhexyl acrylate copolymer or styrene-2-ethylhexyl acrylate-methyl methacrylate copolymer.

15. A black developer according to claim 14, wherein the fluorine-containing resin is vinylidene fluoride-tetrafluoroethylene copolymer, and the styrene type resin is styrene-2-ethylhexyl acrylate-methyl methacrylate copolymer.

* * * * *

UNITED STATES PATENT AND TRADEMARK OFFICE

CERTIFICATE OF CORRECTION

PATENT NO. : 5,116,711

DATED : May 26, 1992

INVENTOR(S) : HIROYUKI KOBAYASHI, ET AL.

It is certified that error appears in the above-identified patent and that said Letters Patent is hereby corrected as shown below:

TITLE PAGE

IN [56] REFERENCES CITED

Under U.S. PATENT DOCUMENTS, "2,874,063 3/1953 Greig ." should read --2,874,063 2/1959 Greig .--.

SHEET 3 OF 6

FIG. 3, "COMPARTIVE" should read --COMPARATIVE--.

COLUMN 1

Line 27, "pictures," should read --and--.
Line 64, "photo-conductive" should read --photoconductive--.

COLUMN 3

Line 2, "significant" should read --sufficient--.
Line 47, "full color" should read --full-color--.

COLUMN 4

Line 50, "composition, comprising" should read --composition comprises--.
Line 68, "respect" should read --respect to--.

COLUMN 5

Line 4, "composition, comprising" should read --composition comprises--.
Line 17, "$5\times10^{9}$" should read --$5\times10^{4}$--.
Line 39, "above mentioned" should read --above-mentioned--.
Line 52, "of developer" should read --of the developer--.

--

UNITED STATES PATENT AND TRADEMARK OFFICE

CERTIFICATE OF CORRECTION

PATENT NO. : 5,116,711

DATED : May 26, 1992

INVENTOR(S) : HIROYUKI KOBAYASHI, ET AL.

It is certified that error appears in the above-identified patent and that said Letters Patent is hereby corrected as shown below:

COLUMN 6

Line 32, "chage" should read --charge--.

COLUMN 8

Line 41, "cause" should read --causes--.
Line 60, "be" should be deleted.

COLUMN 9

Line 8, "occupies" should read --occupy--.
Line 11, "occupies" should read --occupy--.
Line 14, "4.0μ" should read --14.0μ--.

COLUMN 10

Line 49, "apparatus at" should read --apparatus occurs at--.

COLUMN 12

Line 14, "chromaticies" should read --chromaticities--.
Line 21, "assume" should read --assumes--.
Line 22, "have" should read --has--.
Line 64, "are" should read --and--.

COLUMN 13

Line 44, "providing" should read --(providing--.
Line 49, "thereof)." should read --thereof.--.
Line 55, "metal" should read --metals--.

UNITED STATES PATENT AND TRADEMARK OFFICE

CERTIFICATE OF CORRECTION

PATENT NO. : 5,116,711

DATED : May 26, 1992

INVENTOR(S) : HIROYUKI KOBAYASHI, ET AL.

It is certified that error appears in the above-identified patent and that said Letters Patent is hereby corrected as shown below:

COLUMN 15

Line 47, "Example" should read --Examples--.

COLUMN 16

Line 40, "group" should read --groups--.

COLUMN 18

Line 17, "improver A" should read --improver). A--.
Line 22, "100 mesh" should read --100-mesh--.

COLUMN 19

Line 23, "Totally" should read --A total of--.
Line 66, "$x(\lambda)$, $y(\lambda)$" should read --$\bar{x}(\lambda)$, $\bar{y}(\lambda)$--.
Line 67, "$z(\lambda)$" should read --$\bar{z}(\lambda)$--.

COLUMN 20

Line 9, "Z0" should read --$Z_0$--.
Line 24, "colorimetry" should read --calorimetry--.
Line 63, "$C \times V/(W_1-W_2)$" should read --$C \times V/(W_1-W_2)$.--.

COLUMN 21

Line 32, "Yet" should read --As yet--.

UNITED STATES PATENT AND TRADEMARK OFFICE

CERTIFICATE OF CORRECTION

PATENT NO. : 5,116,711

DATED : May 26, 1992

INVENTOR(S) : HIROYUKI KOBAYASHI, ET AL.

It is certified that error appears in the above-identified patent and that said Letters Patent is hereby corrected as shown below:

COLUMN 22

Line 12, "humaric" should read --fumaric--.
Line 50, "so a" should read --so as--.

COLUMN 23

Line 17, "oppoiste" should read --opposite--.

COLUMN 24

Line 12, "shows" should read --show--.

COLUMN 27

Line 50, "stable" should read --stably--.
Line 55, "Example" should read --Example 1--.

COLUMN 28

Line 26, "of" should read --at--.
Line 27, "viscosity of" should read --viscosity at--.
Line 31, "chromatically" should read --chromaticity--.
Line 39, "350 mesh-on and" should read --350 mesh-on; and--.
Line 60, "mixture" should read --mixtures--.

COLUMN 29

Line 22, "about" should read --above--.
Line 26, "2.0%," should read --20%,--.
Line 29, "$7.5\times10^{10}$" should read --$7.5\times10^{4}$--.

UNITED STATES PATENT AND TRADEMARK OFFICE

CERTIFICATE OF CORRECTION

PATENT NO. : 5,116,711

DATED : May 26, 1992

INVENTOR(S) : HIROYUKI KOBAYASHI, ET AL.

It is certified that error appears in the above-identified patent and that said Letters Patent is hereby corrected as shown below:

COLUMN 30

Line 9, "0.8 g/cm$^3$;" should read --0.8 g/cm$^3$; and--.

Signed and Sealed this

Fourth Day of January, 1994

Bruce Lehman

*Attest:*

BRUCE LEHMAN

*Attesting Officer*

*Commissioner of Patents and Trademarks*